US005948584A

United States Patent [19]

Hashimoto et al.

[11] Patent Number: 5,948,584

[45] Date of Patent: Sep. 7, 1999

[54] TONER FOR DEVELOPING ELECTROSTATIC IMAGES AND IMAGE FORMING METHOD

[75] Inventors: Akira Hashimoto, Numazu; Tsutomu Kukimoto, Yokohama; Satoshi Yoshida, Mishima; Manabu Ohno; Yasukazu Ayaki, both of Numazu; Satoshi Handa, Shizuoka-ken, all of Japan

[73] Assignee: Canon Kabushiki Kaisha, Tokyo, Japan

[21] Appl. No.: 09/081,085

[22] Filed: May 19, 1998

[30] Foreign Application Priority Data

May 20, 1997 [JP] Japan ..... 9-129190

[51] Int. Cl.[6] ..... G03G 9/097; G03G 13/22

[52] U.S. Cl. ..... 430/110; 430/124; 430/126

[58] Field of Search ..... 430/110, 124, 430/126

[56] References Cited

U.S. PATENT DOCUMENTS

| | | | |
|---|---|---|---|
| 3,666,363 | 5/1972 | Tanaka et al. . | |
| 4,071,361 | 1/1978 | Marushima . | |
| 5,126,224 | 6/1992 | Hyosu et al. | 430/106.6 |
| 5,153,377 | 10/1992 | Kuwashima et al. | 358/300 |
| 5,210,617 | 5/1993 | Tomiyama et al. | 358/300 |
| 5,307,122 | 4/1994 | Ohno et al. | 430/111 |
| 5,333,059 | 7/1994 | Hyosu et al. | 358/300 |
| 5,338,638 | 8/1994 | Tsuchiya et al. | 430/106 |
| 5,489,498 | 2/1996 | Ohno et al. | 430/110 |
| 5,578,407 | 11/1996 | Kasuya et al. | 430/106 |
| 5,679,490 | 10/1997 | Yachi et al. | 430/110 |
| 5,712,073 | 1/1998 | Katada et al. | 430/110 |
| 5,744,276 | 4/1998 | Ohno et al. | 430/110 |
| 5,747,209 | 5/1998 | Takiguchi et al. | 430/110 |
| 5,795,694 | 8/1998 | Uchiyama et al. | 430/109 |

FOREIGN PATENT DOCUMENTS

| | | |
|---|---|---|
| 0658816 | 6/1995 | European Pat. Off. . |
| 0726503 | 8/1996 | European Pat. Off. . |
| 0772093 | 5/1997 | European Pat. Off. . |
| 0822458 | 2/1998 | European Pat. Off. . |
| 36-10231 | 7/1961 | Japan . |
| 52-3305 | 1/1977 | Japan . |
| 56-13945 | 4/1981 | Japan . |
| 56-116043 | 9/1981 | Japan . |
| 57-52574 | 11/1982 | Japan . |
| 59-53856 | 3/1984 | Japan . |
| 59-61842 | 4/1984 | Japan . |
| 60-217366 | 10/1985 | Japan . |
| 60-252360 | 12/1985 | Japan . |
| 60-252361 | 12/1985 | Japan . |
| 61-94062 | 5/1986 | Japan . |
| 61-138259 | 6/1986 | Japan . |
| 61-273554 | 12/1986 | Japan . |
| 62-14166 | 1/1987 | Japan . |
| 1-109359 | 4/1989 | Japan . |
| 2-79860 | 3/1990 | Japan . |
| 3-50559 | 3/1991 | Japan . |
| 4-86828 | 3/1992 | Japan . |
| 4-250462 | 9/1992 | Japan . |
| 7-120965 | 5/1995 | Japan . |

*Primary Examiner*—Roland Martin

*Attorney, Agent, or Firm*—Fitzpatrick, Cella, Harper & Scinto

[57] ABSTRACT

A toner for developing electrostatic images is formed from toner particles containing at least a binder resin, a colorant, and a wax. The binder resin comprises a vinyl polymer component and a polyester component. The binder resin contains 40–99 wt. % of a component A, 0–20 wt. % of a component B, and 0–60 wt. % of a component C, the components B and C providing totally 1–60 wt. % of the binder resin. The component A comprises low- and medium-molecular weight components having molecular weights of below $10^6$, and the component B comprises high-molecular weight components having molecular weights of at least 106, respectively, based on a chromatogram obtained by gel permeation chromatography of a tetrahydrofuran (THF)-soluble component of the binder resin, and the component C is a THF-insoluble component of the binder resin. The GPC chromatogram of the THF-soluble component of the binder resin exhibits a main peak in a molecular weight region of $3\times10^3$–$5\times10^4$. The toner particles have a shape factor SF-1 of 100–160 and a shape factor SF-2 of 100–140.

67 Claims, 6 Drawing Sheets

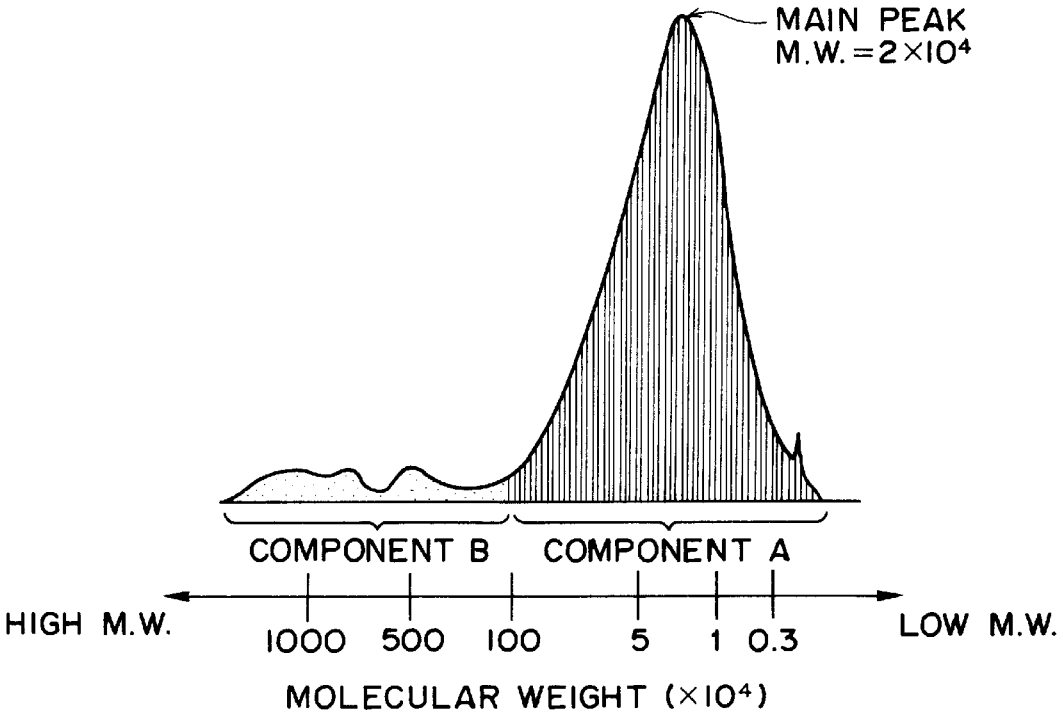
FIG. 1: GPC CHROMATOGRAM FOR THF-SOLUBLE MATTER IN TONER PAARICLES (A)
FIG. 2A
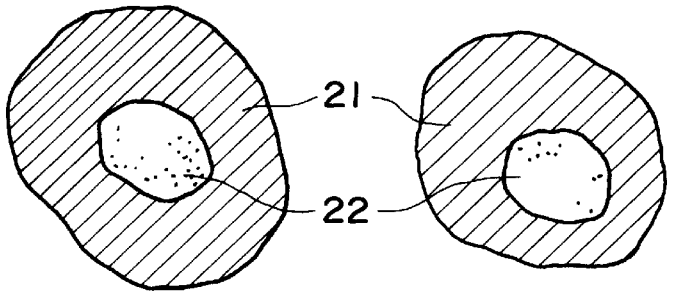
FIG. 2B
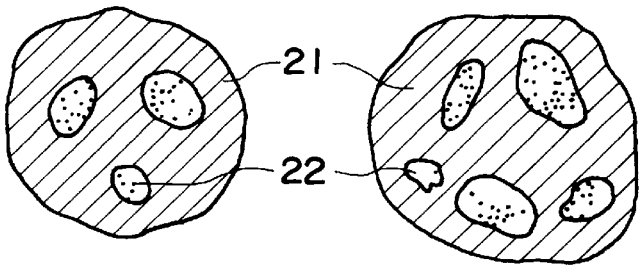

TONER FOR DEVELOPING ELECTROSTATIC IMAGES AND IMAGE FORMING METHOD

FIELD OF THE INVENTION AND RELATED ART

The present invention relates to a toner for developing electrostatic images used in image forming methods, such as electrophotography and electrostatic printing, and an image forming method using the toner. Particularly, the present invention relates to a toner for developing electrostatic images used for forming a visible image of the toner which is fixed according to a fixation scheme wherein the toner image is fixed under application of heat and pressure onto a transfer-receiving material, such as paper, and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is transferred via or without via an intermediate transfer member onto a transfer(-receiving) material such as paper etc., as desired, fixed by heating, pressing, or heating and pressing, or with solvent vapor to obtain a copy or print carrying a fixed toner image. A portion of the toner remaining on the photosensitive member without being transferred is cleaned by various means, and the above mentioned steps are repeated for a subsequent cycle of image formation.

An example of ordinary full-color image forming process will now be described. A photosensitive member (electrostatic image-bearing member) in the form of a drum is uniformly charged by a primary charger and then subjected to imagewise exposure with laser light modulated by a magenta image signal obtained from an original to form an electrostatic image on the photosensitive drum, which is then developed with a magenta toner contained in a magenta developing device to form a magenta toner image. Then, the magenta toner image formed on the photosensitive drum is transferred directly or indirectly onto a transfer material under the action of a transfer charger.

The photosensitive drum after the above-mentioned developing of an electrostatic image is charge-removed by a charge-removing charger and cleaned by a cleaning means so as to be prepared for a subsequent cyan-image forming cycle including charging again by the primary charger, a cyan toner image formation and a transfer of the cyan toner image onto the transfer material carrying the magenta toner image already transferred thereto, followed further by a yellow-image forming cycle and a black image forming cycle to provide the transfer material with four-color toner images thereon. Then, the transfer material carrying the four-color toner images is subjected to fixation under application of heat and pressure, thereby forming a full-color image.

In recent years, an image-forming apparatus performing an image forming method as described above not only is used as a business copier for simply reproducing an original but also has been used as a printer, typically a laser beam printer (LBP), for computer output, and a personal copier (PC) for individual users.

In addition to such uses as representatively satisfied by a laser beam printer, the application of the basic image forming mechanism to a plain paper facsimile apparatus is also popular.

For such uses, the image forming apparatus has been required to be smaller in size and weight and satisfy higher speed, higher quality and higher reliability. Accordingly, the apparatus has been composed of simpler elements in various respects. As a result, the toner used therefor is required to show higher performances. Further, in accordance with various needs for copying and printing, a greater demand is urged for color image formation, and a higher image quality and a higher resolution are required for faithfully reproducing an original color image. There is also an increasing demand for an image forming system allowing the formation of an image sheet having images on both sides from an original sheet having images on both sides.

In order to comply with the demands for a toner used in such a color image forming process, each color toner is required to exhibit excellent meltability and color-mixing characteristic on heating under application of a pressure. For this purpose, it is preferred to use a toner having a low softening point and a melt-viscosity which sharply decreases down to a low value below a prescribed temperature (i.e., having a high degree of sharp melting characteristic). By using such a toner, it is possible to provide a color copy satisfying a broader range of color reproducibility and faithful to the original image.

However, such a color toner having a high degree of sharp meltability generally has a high affinity to a fixing roller and is liable to cause offsetting onto the fixing roller at the time of fixation.

Particularly, in the case of a fixing device for a color image forming apparatus, a plurality of toner layers including those of magenta toner, cyan toner, yellow toner and black toner, are formed on a transfer-receiving material, so that the offset is liable to be caused as a result of an increased toner layer thickness.

Hitherto, in order to prevent the attachment of a toner onto a fixing roller surface, it has been practiced to compose the roller surface of a material, such as a silicone rubber or a fluorine-containing resin, showing excellent releasability against a toner, and coat the roller surface with a film of a liquid showing a high releasability, such as silicone oil or a fluorine-containing oil, for the purpose of preventing offset and deterioration of the roller surface. However, such a measure, though very effective for preventing toner offset, requires an equipment for supplying the offset-preventing liquid and complicates the fixing device. Further, the oil application is liable to promote a peeling between layers constituting the fixing roller, thus causing a shorter life of the fixing roller.

Accordingly, based on a concept of not using such a silicone oil-supplying device but supplying an offset-preventing liquid from toner particles on heating under pressure, it has been proposed to incorporate a release agent, such as low-molecular weight polyethylene or low-molecular weight polypropylene within toner particles.

For example, the incorporation of a wax in toner particles has been disclosed in Japanese Patent Publication (JP-B) 52-3304, JP-B 52-3305 and Japanese Laid-Open Patent Application (JP-A) 57-52574.

Further, the incorporation of a wax in toner particles is also disclosed in JP-A 3-50559, JP-A 2-79860, JP-A 1-109359, JP-A 62-14166, JP-A 61-273554, JP-A 61-94062, JP-A 61-138259, JP-A 60-252361, JP-A 60-252360 and JP-A 60-217366.

Wax has been used in order to provide improved anti-offset characteristic of the toner at low or high temperatures, and also an improved fixability at low temperatures. On the other hand, the resultant toner is liable to have a lower anti-blocking property or ununiform chargeability.

In order to provide a toner with improved low-temperature fixability and high-temperature anti-offset characteristic and also improved anti-blocking performance, it has been proposed to provide improved toner binder resin. For example, JP-A 4-250462 discloses a toner comprising a block or graft copolymer of crystalline polyester and styrene-butadiene copolymer as a binder resin. JP-A 4-86828 discloses a toner containing a binder resin obtained by polymerizing vinyl monomers containing 0.01–5.0 wt. % of a polyfunctional vinyl monomer and unsaturated polyester.

However, in view of Examples of JP-A 4-250462, the styrene-butadiene copolymer before the grafting already has a very large weight-average molecular weight of $7.3\times10^5$ so that the resultant toner containing a binder resin comprising the polymer after the grafting is caused to have an insufficient low-temperature fixability.

The toner of JP-A 4-86828 also contains a resin having a peak molecular weight exceeding $5\times10^4$ and accordingly leaves a room for improvement regarding the low-temperature fixability while it exhibits a certain degree of improvement regarding the high-temperature anti-offset characteristic.

Toners have been conventionally produced through the so-called pulverization process, but also a toner obtained through a suspension polymerization process has been proposed (JPB 36-10231). In the suspension polymerization process, a monomer composition is prepared by uniformly mixing (i.e., dissolving or dispersing) a polymerizable monomer and a colorant, and optionally a polymerization initiator, a crosslinking agent, a charge control agent, and other additives, and the monomer composition is dispersed in an aqueous medium containing a dispersion stabilizer under the action of an appropriate stirrer, and subjected to polymerization, thereby providing toner particles having a desired particle size.

For the purpose of providing a toner having an improved chargeability through the suspension polymerization process, JP-A 56-116043 discloses a toner production process wherein a reactive polyester is added to a vinyl monomer composition containing carbon black in a proportion of 10–50 wt. parts with respect to 100 wt. parts of the monomer. The unsaturated polyester has a very large weight-average molecular weight of $1.7\times10^5$ and is used in a large amount, so that the resultant toner is understood to contain a total amount of THF-insoluble content and components having molecular weights exceeding $10^6$ exceeding 60 wt. % of the binder resin. As a result, the toner is caused to have an insufficient low-temperature fixability.

In the suspension polymerization process, the monomer composition is dispersed into liquid droplets in a dispersion medium, such as water, having a large polarity. Accordingly, a component having a polar group contained in the monomer composition is concentrated at the surface of the droplets, i.e., the boundary with the aqueous phase, and non-polar components are predominantly present at the inner part, thus providing a so-called core/shell structure.

JP-A 7-120965 discloses a toner comprising toner particles coated with an outer shell resin principally comprising an amorphous polyester obtained through such a suspension polymerization process. More specifically, the JP reference discloses a process wherein an amorphous polyester having a tan δ in the range of 1.0–20.0 at 80–120° C. is dissolved in a monomer composition containing styrene, etc., and the monomer composition is subjected to polymerization, thereby simultaneously forming an outer shell of the amorphous polyester. The thus-obtained toner can exhibit relatively good fixability, but the amorphous polyester having a tan δ of 1.0–20.0 does not necessarily have a good solubility in the monomer, so that it is difficult to provide toner particles with little fluctuation in performance.

A toner according to the polymerization process can satisfy in combination a low-temperature fixability, anti-blocking characteristic and anti-high-temperature offset characteristic which are generally contradictory to each other, and can prevent high-temperature offset without applying a release agent such as oil onto the fixing roller, owing to the encapsulation of a wax component as a release agent.

As mentioned hereinbefore, there is an increasing demand for obtaining a copy sheet or image sheet having images on both sides from a both-side image original or a one-side image original in recent years and, for complying with the demand, a toner providing such both-side image sheet having high image qualities at a high reliability, is desired.

Among various difficulties accompanying the formation of an image sheet having color images on both sides encountered hitherto, one of the most serious difficulties has been paper curling occurring after the fixation of an image on one side. If the paper curling is extensive, the conveyability of the one-side image sheet becomes inferior, thus failing to provide an image sheet high quality and reliability images on both sides. In order to solve the difficulty, a toner is required to provide high quality images having satisfactory image density and color reproducibility with a small amount of the toner transferred onto the transfer sheet. In order to satisfy the requirement, the toner is required to exhibit an improved coloring power. Further, in the two-side image formation process, one-side image is caused to pass twice through the fixing device, so that the toner is required to have a further improved high-temperature anti-offset characteristic.

SUMMARY OF THE INVENTION

A generic object of the present invention is to provide a toner for developing electrostatic images having solved the above-mentioned problems.

A more specific object of the present invention is to provide a toner for developing electrostatic images having improved fixability and anti-offset characteristic.

Another object of the present invention is to provide a toner for developing electrostatic images suitable for use in an electrophotographic process wherein high-quality images can be provided stably for a long period without adversely affecting a photosensitive member, a toner-carrying member or developer-carrying member, or an intermediate transfer member.

A further object of the present invention is to provide an image forming method using the toner.

According to the present invention, there is provided a toner for developing electrostatic images, comprising: toner particles containing at least a binder resin, a colorant, and a wax, wherein (I) the binder resin comprises a vinyl polymer component and a polyester component;

(II) the binder resin contains 40–99 wt. % of a component A, 0–20 wt. % of a component B, and 0–60 wt. % of a component C, the components B and C providing totally 1–60 wt. % of the binder resin; wherein the component A comprises low- and medium-molecular weight components having molecular weights of below $10^6$ and the component B comprises high-molecular weight components having molecular weights of at least $10^6$, respectively, based on a chromatogram obtained by gel permeation chromatography of a tetrahydrofuran (THF)-soluble component of the binder resin, and the component C is a THF-insoluble component of the binder resin;

(III) the chromatogram obtained by GPC of the THF-soluble component of the binder resin exhibits a main peak in a molecular weight region of $3\times10^3$–$5\times10^4$; and (IV) the toner particles have a shape factor SF-1 of 100–160 and a shape factor SF-2 of 100–140.

According to another aspect of the present invention, there is provided an image forming method, comprising:

a charging step for applying a voltage to a charging member from an external source, thereby charging an electrostatic image-bearing member, a latent image forming step for forming an electrostatic image on the charged electrostatic image-bearing member;

a developing step for developing the electrostatic image with a toner to form a toner image on the electrostatic image-bearing member, a transfer step for transferring the toner image on the electrostatic image-bearing member onto a transfer material, and a fixing step for fixing the toner image on the transfer material under application of heat and pressure;

wherein the toner is of the type described above of the present invention.

According to the present invention, there is further provided an image forming method, comprising:

a charging step for applying a voltage to a charging member from an external source, thereby charging an electrostatic image-bearing member, a latent image forming step for forming a first electrostatic image on the charged electrostatic image-bearing member, a developing step for developing the first electrostatic image with a first toner to form a first toner image on the electrostatic image-bearing member, a first type of transfer step for transferring the first toner image on the electrostatic image-bearing member onto an intermediate transfer member, a charging step for applying a voltage to the charging member from the external source, thereby charging the electrostatic image-bearing member, a latent image forming step for forming a second electrostatic image on the charged electrostatic image-bearing member, a developing step for developing the second electrostatic image with a second toner to form a second toner image on the electrostatic image-bearing member, a first type of transfer step for transferring the second toner image on the electrostatic image-bearing member onto the intermediate transfer member, a second type of transfer step for transferring the first toner image and the second toner image on the intermediate transfer member onto a transfer material, and a fixing step for fixing the first and second toner images on the transfer material under application of heat and pressure;

wherein at least one of the first and second toners is of the type described above of the present invention.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 shows a GPC chromatogram for THF-soluble component of Toner particles (A) prepared in Example 1.

FIGS. 2A and 2B are respectively a sectional illustration of toner particles containing a wax component dispersed in the toner particles.

DETAILED DESCRIPTION OF THE INVENTION

Figure 3:
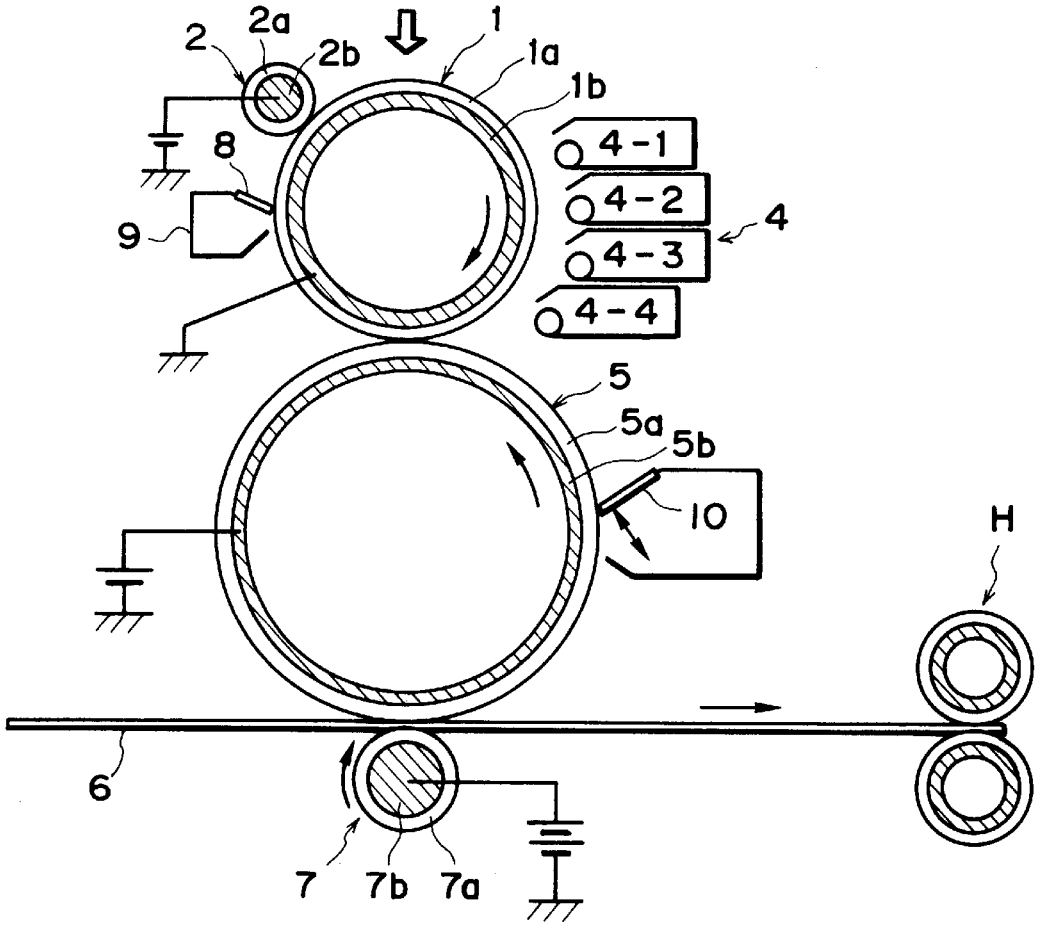
FIG. 3 schematically illustrates an example of image forming apparatus suitably used for practicing an embodiment of the image forming method of the invention.

In the toner of the present invention, toner particles contain at least a binder resin, a colorant, and a wax, wherein (I) the binder resin comprises a vinyl polymer component and a polyester component;

(II) the binder resin contains 40–99 wt. % of a component A, 0–20 wt. % of a component B, and 0–60 wt. % of a component C, the components B and C providing totally 1–60 wt. % of the binder resin; wherein the component A comprises low- and medium-molecular weight components having molecular weights of below $10^6$ and the component B comprises high-molecular weight components having molecular weights of at least $10^6$, respectively, based on a chromatogram obtained by gel permeation chromatography of a tetrahydrofuran (THF)-soluble component of the binder resin, and the component C is a THF-insoluble component of the binder resin;

(III) the chromatogram obtained by GPC of the THF-soluble component of the binder resin exhibits a main peak in a molecular weight region of $3\times10^3$–$5\times10^4$; and (IV) the toner particles have a shape factor SF-1 of 100–160 and a shape factor SF-2 of 100–140.

The vinyl polymer component may be composed of a vinyl polymer, which may be a vinyl homopolymer, such styrene homopolymer, or a vinyl copolymer, such as styrene-acrylic (or styrene-(meth)acrylate copolymer).

More specifically, such vinyl polymer may be formed from vinyl monomers, examples of which may include: styrene monomers, such as styrene, o-, m- or p-methylstyrene, and m- or p-ethylstyrene; (meth)acrylate ester monomers, such as methyl (meth)acrylate, ethyl (meth) acrylate, propyl (meth)acrylate, butyl (meth)acrylate, octyl (meth)acrylate, dodecyl (meth)acrylate, stearyl (meth) acrylate, behanyl (meth)acrylate, 2-ethylhexyl (meth) acrylate, methylaminoethyl (meth)acrylate, and diethylaminoethyl (meth)acrylate; butadiene, isoprene, cyclohexene, (meth)acrylonitrile, and acrylamide. These monomers may be used singly or in mixtures so as to provide a polymer giving a theoretical glass transition temperature (Tg) described in Polymer Handbook, Second Edition, III, pp. 139–192 (John Wilery & Sons) of 40–75° C. If the theoretical glass transition temperature is below 40° C., the resultant toner is liable to suffer from difficulties with respect to storage stability and continuous image forming stability. On the other hand, in excess of 75° C., the toner shows an increased fixable temperature. This is particularly undesirable for color toners for forming full-color images, as the color mixability of the respective color toners is lowered to result in inferior color reproducibility and OHP images with lowered transparency.

The molecular weight (distribution) of a binder resin may be measured by gel permeation chromatography (GPC). In a specific measurement method, a solution of a binder resin or a toner comprising such a binder resin in tetrahydrofuran (THF) is filtrated through a solvent-resistant membrane filter having a pore size (diameter) of 0.2 $\mu$m to prepare a sample solution, which is then subjected to GPC by using, e.g., a GPC apparatus (e.g., "GPC-150C", available from Waters Co.). The sample solution may be prepared so as to provide a binder resin concentration of 0.05–0.6 wt. %. The sample solution may be injected in an amount of 50–200 $\mu$l. The columns may comprise a series of, e.g., A-801, 802, 803, 804, 805, 806 and 807 available from Showa Denko K.K., and a calibration cure for providing a molecular weight distribution may be prepared by using standard polystyrenes. Thus, typical GPC measurement conditions may be summarized as follows.

<GPC Measurement Conditions for Binder Resin>

Apparatus: GPC-150C (available from Waters Co.)

Column: Series of seven columns of KF801–807 (available from Showalex K.K.)

Temperature: 40° C.

Solvent: THF

Flow rate: 1.0 ml/min.

Sample: 0.1 ml of a sample solution at a concentration of 0.05–0.6 wt. %.

More specifically, the calibration curve may be prepared as a relationship between molecular weights plotted on a logarithmic scale and number of counts given by the GPC measurement by using several monodisperse polystyrene standard samples. It is advisable to use at least 10 standard polystyrene samples having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ available from, e.g., Pressure Chemical Co. or Toyo Soda Kogyo K.K. The detection may be performed by using an RI (refractive index) detector. An example of GPC chromatogram is shown in FIG. 1 (for THF-soluble component of Toner particles (A) obtained in Example 1).

The binder resin constituting the toner of the present invention contains the component B having molecular weights of at least $10^6$ in a proportion of 0–20 wt. % of the total binder resin. A larger proportion may provide a good anti-high-temperature offset characteristic but results in an inferior low-temperature fixability. The component B content (wt. %) referred to herein is based on values measured in the following manner.

Ca. 1 g of toner particles or a toner is accurately weighed and is placed in a cylindrical filter paper and subjected to 20 hours of Soxhlet extraction with 200 ml of THF. Then, the cylindrical filter paper is taken out and sufficiently dried under vacuum at 30–40° C. to measure a residue weight.

The toner (or toner particles) contains components other than the binder resin, such as a pigment, a charge control agent, a release agent and an external additive. Accordingly, the contents of these other components and whether they are soluble or insoluble in THF, are taken into consideration to calculate the content of the THF-insoluble matter (the component C) in the binder resin according to the following equation.

THF-insoluble content in binder resin (wt. %)=[(the residue weight)−(the content of THF-insoluble components other than the binder resin)]/[(the weight of charged toner (particles))−(the total weight of all the components other than the binder resin)]×100.

Then, a GPC chromatogram of the binder resin is obtained by the above-mentioned GPC measurement, and from the GPC chromatogram, the areal % of the component B having molecular weights of at least $10^6$ is measured with respect to the THF-soluble matter in the binder resin. The wt. % of the component B in the THF-soluble matter of the binder resin is assumed to be equal to the areal % of the component B based on the GPC chromatogram. Then, the wt. % of the component B in the THF-soluble matter is converted into a wet. % thereof in the total binder resin including the THF-insoluble content by multiplying it with a weight percentage of the THF-soluble matter in the binder resin.

In case where the toner (or toner particles) contains a THF-soluble component (such as a THF-soluble wax component) other than the binder resin, the amount thereof (also in consideration of its molecular weight) is subtracted from the component A and/or the component B to obtain the amount of the components A and B in the binder resin.

The value calculated in the above-described manner represents the wt. % of the component B having molecular weights of at least $10^6$ in the total binder resin.

In the toner of the present invention, the content of THF-insoluble matter (the component C) in the binder resin is 0–60 wt. % of the total binder resin. In excess of 60 wt. %, the resultant toner is caused to have an inferior low-temperature fixability. Even if the THF-insoluble matter content is 0 wt. %, good anti-offset characteristic and continuous image forming characteristic can be attained if the component B content is in the range of 1–20 wt. %.

The total content of the components B and C is 1–60 wt. %, preferably 5–58 wt. %, of the binder resin. If the total content is below 1.0 wt. %, the resultant toner is caused to have inferior anti-high-temperature offset characteristic, anti-blocking property and developing performance. On the other hand, in excess of 60 wt. %, the fixability is lowered.

The component C (i.e., THF-insoluble resin component) in the binder resin may be produced, e.g., by copolymerizing a monomer such as styrene and a crosslinking agent such as divinylbenzene, or by polymerizing such a monomer and optionally such a crosslinking agent in the presence of an unsaturated polyester.

In view of anti-blocking property and developing performance, the component B and/or the component C may preferably contain a polyester component, desirably in a proportion of 0.02–90 wt. %, preferably 0.2–80 wt. %, further preferably 1–70 wt. %, of the total amount of the components B and C. If the polyester content is below 0.02 wt. %, the anti-blocking property and developing performance are liable to be lowered, and in excess of 90 wt. %, the developing performance is liable to be lowered.

The polyester component may preferably occupy 0.1–20 wt. %, more preferably 0.1–10 wt. %, most preferably 0.1–5 wt. %, of the binder resin in view of the developing performance and environmental stability.

The polyester component in the components B and C may be qualitatively and quantitatively analyzed, e.g., in the following manner.

In order to analyze the THF-insoluble matter, a toner (or toner particles) may be subjected to Soxhlet extraction with THF in the above-described manner, and the resin component in the dried residue captured on the filter paper may be analyzed in various manners, such as spectrometry including nuclear magnetic resonance spectrometry ($^{1}$H-NMR, $^{13}$C-NMR), infrared absorption spectrometry (IR), ultraviolet absorption spectrometry (UV) and mass spectrometry (MS); elementary analysis, and other chemical analyses (e.g., measurement of acid value and hydroxyl value). It is also possible to apply visible spectrometry by reacting a hydroxyl group or a carboxyl group in the polyester component structure with a dye, etc. These measurement methods may be used singly or in combination.

The qualitative and quantitative analyses of polyester components in the component B can also be performed by GPC-IR wherein an IR apparatus is directly connected to a GPC apparatus, or by recovering the B component by means of a preparative HPLC (high-performance liquid chromatography) apparatus, e.g., one described below under conditions set to exactly reflect the results of GPC and subjecting the recovered B component to an analysis method as described above.

Preparative HPLC apparatus: Recycle preparative HPLC Model LC-908 (available from Nippon Bunseki Kogyo K.K.)

Preparative column: Selected appropriately from JAIGEL-1H to 6H, JAIGEL-LS205 (available from Nippon Bunseki Kogyo K.K.).

The recovered sample may be identified according to the GPC measurement described above.

As another analysis method, the selectively recovered B component after sufficient drying may be fractionated by extraction with a single solvent or a mixture solvent to quantitatively analyze the polyester component.

The components B and C containing the polyester component in a proportion of 0.02–90 wt. % may be prepared from a reactive polyester.

Such a reactive polyester may for example be prepared through polycondensation of a polybasic acid, such as terephthalic acid, isophthalic acid, phthalic acid, adipic acid, maleic acid, succinic acid, sebacic acid, thiodiglycolic acid, diglycolic acid, malonic acid, glutaric acid, pimelic acid, suberic acid, azelaic acid, camphoric acid, cyclohexanedicarboxylic acid, or trimellitic acid; with a polyhydric alcohol, such as ethylene glycol, diethylene glycol, 1,3-propylene glycol, 1,4-butanediol, neopentyl glycol, 1,4-bis(hydroxymethyl)cyclohexane, 1,4-bis(2-hydroxyethyl) benzene, 1,4-cyclohexanedimethanol, polyethylene glycol, polypropylene glycol, bisphenol A, hydrogenated bisphenol, ethylene oxide-adduct of bisphenol A, propylene oxide-adduct of bisphenol A, glycerin, trimethylolpropane or pentaerythritol. The resultant polycondensate (i.e., reactive polyester) has a reactive group in its main chain or side chain. Examples of the reactive group may include: carboxylic acid group or its salt, sulfonic acid group or its salt, ethyleneimino acid group, epoxy group, isocyanate group, double bond, acid anhydride group, and halogen atom. By reacting such a reactive polyester with another reactive polyester or with a polyfunctional crosslinking agent (such as polyhydric alcohol or polybasic acid), or by reacting such a reactive polyester with a vinyl monomer (as by copolymerization), the components B and C may be obtained. In the case of producing toner particles directly from a monomer composition by the polymerization process, for example, the components B and C may be produced by using an unsaturated polyester as the reactive polyester and copolymerizing it with a vinyl monomer (optionally together with a crosslinking agent, such as divinylbenzene). In this case, it is easy to compose the surface (i.e., outer shell) of the toner particles with the component B and/or the component C comprising the polyester component, thus providing toner particles with particularly excellent anti-blocking property and anti-offset characteristic.

In order to produce the component C, it is preferred to use a polyfunctional vinyl monomer as a crosslinking agent. Examples of the polyfunctional vinyl monomer may include: aromatic divinyl compounds, such as divinylbenzene and divinylnaphthalene; carboxylic acid esters having two double bonds, such as ethylene glycol diacrylate, ethylene glycol dimethacrylate, and 1,3-butanediol dimethacrylate; divinyl compounds, such as divinylaniline, divinyl ether, divinyl sulfide, and divinyl sulfone; and compounds having three or more vinyl groups. These compounds may be used singly or in mixture.

If the reactive polyester possibly used in the present invention has too low a molecular weight, a portion of the polyester not participating in the crosslinking reaction can be present at the surface of toner particles, thus resulting in lower anti-blocking property. If the molecular weight is too high, the preparation of toner particles directly by the polymerization process becomes difficult since the dissolution of the reactive polyester in the vinyl monomer becomes difficult. Accordingly, it is suitable for the reactive polyester to have a weight-average molecular weight of 3,000–100,000, in order to provide a toner having particularly excellent performances. Also in the case of the reactive polyester being unsaturated polyester, it is preferred to have a weight-average molecular weight (Mw) of 3,000–100,000, particularly 3,000–30,000, for reaction with a vinyl monomer to produce the components B and C exhibiting preferred electrophotographic performances.

It is preferred for the binder resin to contain the components B and C in a total content of 5–58 wt. % of the binder resin in order to provide improved anti-high-temperature offset characteristic and anti-blocking property. It is further preferred that the binder resin contains the component B in a proportion of 2–15 wt. %, more preferably 2–10 wt. %, and the component C in a proportion of 3–55 wt. %, more preferably 5–45 wt. %. It is preferred that the total of the components B and C occupies 7–49 wt. % of the binder resin, and the binder resin contains more than 50 wt. % THF-soluble content in order to provide good low-temperature fixability and color mixing performance.

In case where the polyester component is produced from an unsaturated polyester reactive with a vinyl monomer, the unsaturated polyester may preferably have a bisphenol A derivative unit represented by the following formula in order to provide good electrophotographic performance and fixability:

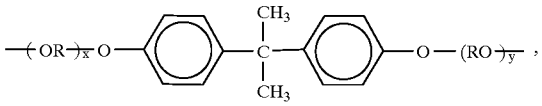

wherein R denotes an ethylene or propylene group, and x and y are respectively an integer of at least 1 providing an average of x+y in a range of 2–10. The unsaturated polyester reactive with a vinyl monomer may preferably be one obtained by polycondensation of a dicarboxylic acid having a vinyl group (i.e., a reactive double bond), such as maleic acid, maleic anhydride, maleic acid ester, fumaric acid or fumaric acid ester, and a dihydric alcohol. The dihydric alcohol may particularly preferably comprise a bisphenol A derivative represented by the following formula (A):

(A)

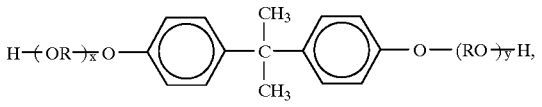

wherein R denotes an ethylene or propylene group, and x and y are respectively an integer of at least 1 providing an average of x+y in a range of 2–10.

Each of the components A, B and C need not be restricted to a single species of polymer. For example, it is possible to use two or more species of reactive polyesters, or two or more species of vinyl polymers. Further, it is also possible to incorporate optionally into the binder resin a different kind of polymers, such as non-reactive polyester, epoxy resin, polycarbonate, polyolefin, polyvinyl acetate, polyvinyl chloride, polyalkyl vinyl ether, polyalkyl vinyl ketone, polystyrene, poly(meth)acrylate, melamine formaldehyde resin, polyethylene terephthalate, nylon, or polyurethane, as desired.

In the toner of the present invention, the binder resin contains a THF-soluble content giving a GPC chromatogram showing a main peak in a molecular weight region of 3,000–50,000, preferably 3,000–40,000, more preferably 10,000–30,000, so as to provide good low-temperature fixability and continuous image forming characteristic on a large number of sheets. It is preferred that the THF-soluble content of the binder resin has a weight-average molecular weight of at least $10^5$ in order to provide improved anti-high-temperature offset characteristic.

The binder resin may comprise 40–99 wt. %, preferably 42–95 wt. %, more preferably 51–93 wt. %, of the component A, respectively based on the binder resin, so as to provide good fixability. It is particularly preferred that the THF-soluble content of the binder resin comprises 0–20%, more preferably 0.5–1.5%, of components having molecular weights of at least $10^6$; 15–45%, more preferably 20–40%, of components having molecular weights of $5\times10^4$–$10^6$; and 45–85%, more preferably 50–79%, of components having molecular weights of below $5\times10^4$, in terms of areal percentage based on its GPC chromatogram, so as to provide satisfactory anti-high-temperature offset characteristic and low-temperature fixability in combination.

The component A may preferably comprise at least 70 wt. %, more preferably at least 75 wt. %, further preferably at least 85 wt. %, of vinyl polymer, so as to retain good environmental stability and low-temperature fixability. Other polymer components, such as polyester, may be contained within an extent of satisfying the above condition.

The polymers in the component A may be qualitatively and quantitatively in similar manners as described with reference to polyesters contained in the components B and C.

The toner particles of the toner according to the present invention contains a wax as a release agent.

Examples of the wax used in the present invention may include: paraffin wax and derivatives thereof, microcrystalline wax and derivatives thereof. Fischer-Tropsche wax and derivatives thereof, polyolefin wax and derivatives thereof, and carnauba wax and derivatives thereof, and the derivatives may include oxides, and block or graft copolymerizates with vinyl monomers. Other wax materials may include higher fatty acids and metal salts thereof, higher aliphatic alcohols, higher aliphatic esters, aliphatic amide wax, ketone, hardened castor oil and derivatives thereof, vegetable waxes, animal waxes, mineral waxes, and petrolactam.

Such a wax may preferably show a heat absorption main peak in a temperature region of 40–150° C. on a DSC heat-absorption curve as measured on temperature increase by using a differential scanning calorimeter. The use of such a wax having a heat-absorption main peak in the temperature region, improves the low-temperature fixability and the releasability. If the heat-absorption main peak appears below 40° C., the wax is liable to show a weak cohesion, thus resulting in inferior anti-high-temperature offset characteristic and too high a gloss. On the other hand, a heat-absorption main peak above 150° C. is liable to result in too high a fixing temperature and a difficulty in providing a fixed image having an appropriately smoothened surface. This is particularly undesirable in the case of a color toner because of a lowering in the color miscibility. Further, in the case of the direct polymerization process for providing a toner including particle formation and polymerization in an aqueous medium, the use of such a wax having a high heat-absorption main peak temperature is liable to cause a difficulty, such as precipitation of the wax during the particle formation.

The measurement of the heat-absorption main peak of a wax component may be performed according to ASTM D3418-8, e.g., by using "DSC-7" available from Perkin-Elmer Corp. The temperature correction of the detector unit may be performed based on melting points of indium and zinc, and the calorie correction may be performed based on the heat of fusion of indium. A sample is placed on an aluminum pan and subjected to measurement at a temperature-raising rate of 10° C./min. together with a blank pan as a control.

It is further preferred that the wax exhibits a heat-absorption main peak in a temperature range of 45–145° C., most preferably 50–100° C., on its DSC heat-absorption curve. Particularly in the case of a color toner, a heat-absorption main peak in the range of 50–100° C. is preferred in view of the color miscibility and anti-offset characteristic.

In the present invention, the addition amount of the wax is basically not restricted but may preferably be 2–30 wt. %, more preferably 3–25 wt. % of the toner particles.

The wax can contain an anti-oxidant within an extent of not adversely affecting the chargeability of the resultant toner.

The toner particles of the toner according to the present invention may preferably have a sectional structure as shown in FIG. 2A or FIG. 2B, when observed through a transmission electron microscope (TEM), wherein spherical and/or spheroidal (or spindle-shaped) wax particle(s) 22 are dispersed in the form of islands without being dissolved within a matrix of binder resin 21 comprising a core portion rich in the vinyl polymer and a surface portion rich in the polyester component. If the wax is enclosed within the binder resin comprising a surface layer rich in the polyester component in this manner, it becomes possible to obviate the deterioration of the toner and soiling of the image forming apparatus, and maintain a good triboelectric chargeability, even if a large amount of the wax is contained in the toner particles. As a result, it becomes possible to form a toner image faithfully reproducing a digital latent image for a long period of image forming operation. Further, as such a large amount of wax can effectively function at the time of heat-pressure fixation, satisfactory low-temperature fixability and anti-offset characteristic are provided in combination.

The cross-section of toner particles may be observed in the following manner. Sample toner particles are sufficiently dispersed in a cold-setting epoxy resin, which is then hardened for 2 days at 40° C. The hardened product is dyed with triruthenium tetroxide optionally together with triosmium tetroxide and sliced into thin flakes by a microtome having a diamond cutter. The resultant thin flake sample is observed through a transmission electron microscope to confirm a sectional structure of toner particles. The dyeing with triruthenium tetroxide may preferably be used in order to provide a contrast between the wax and the outer resin by utilizing a difference in crystallinity therebetween. When toner particles obtained in Examples described hereinafter were subjected to a sectional structure observation through a TEM in the manner described above, they generally showed a structure as shown in FIG. 2A wherein the wax is dispersed in the form of a spherical (and/or spheroidal) island 22 in the matrix of binder resin 21.

The toner particles used in the present invention may have a shape factor SF-1 of 100–160, preferably 100–140, and a shape factor SF-2 of 100–140, preferably 100–120, as measured by an image analyzer.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 500, and 100 images of toner particles having a particle size (diameter) of at least 2 μm are sampled at random. The image data are inputted into an image analyzer ("Luzex 3", available from Nireco K.K.) to obtain averages of shape factors SF-1 and SF-2 based on the following equations:

$$SF\text{-}1=[(MXLNG)^2/AREA]\times(\pi/4)\times100,$$

$$SF\text{-}2=[(PERI)^2/AREA]\times(1/4\pi)\times100,$$

wherein MXLNG denotes the maximum length of a sample particle, PERI denotes the perimeter of a sample particle, and AREA denotes the projection area of the sample particle.

The shape factor SF-1 represents the roundness of toner particles, and the shape factor SF-2 represents the roughness of toner particles.

Hitherto, in case where toner particles having small shape factors SF-1 and SF-2 are used, a cleaning failure is liable to occur and an external additive is liable to be embedded at the toner particle surfaces, thus resulting in inferior image quality. In the present invention, however, it is possible to obviate these difficulties by forming the surface of the toner particles of the component B and/or the component C comprising a polyester component to provide the toner particles with an adequate strength.

If SF-1 exceeds 160, the toner particles are caused to have indefinite shapes resulting in a broad charge distribution and are liable to be ground within the developing apparatus, thus causing an image density lowering and image fog. Further, in case where an intermediate transfer member is included in the image forming apparatus, a lowering in transfer efficiency is recognized both during the transfer of toner images from the electrostatic image-bearing member to the intermediate transfer member and the transfer from the intermediate member to the transfer-receiving material.

In order to provide a high toner image transfer efficiency, the toner particles may preferably have a shape factor SF-2 of 100–140, and a ratio (SF-2/SF-1) of at most 1.0. In case where SF-2 exceeds 140 and the ratio SF-2/SF-1 exceeds 1.0, the toner particle surface is not smooth but is provided with many unevennesses, so that the transfer efficiency is liable to be lowered during the transfer from the electrostatic image-bearing member via the intermediate transfer member to the transfer-receiving material.

Regarding the above-mentioned shape factor measurement method, even if a toner containing an external additive in addition to toner particles is subject to the measurement, the resultant measured values of SF-1 and SF-2 become substantially identical to those of the toner particles alone, since the external additive generally has a much smaller size than the toner particles or, even if some coarse external particles are present, the number thereof is much smaller than that of the toner particles.

In the case of using an intermediate transfer member for complying with various types of transfer-receiving materials, substantially two transfer steps are included so that the lowering in transfer efficiency is liable to result in a lower toner utilization efficiency. In a digital full-color copying machine or printer, a color image original is preliminarily color-separated by a B (blue) filter, a G (green) filter, and an R (red) filter to form latent image dots of 20–70 μm on a photosensitive member, which are then developed with respective color toners of Y (yellow), M (magenta), C (cyan) and Bk (black) to reproduce a multi-color image faithful to the original by subtractive color mixing. In this instance, on the photosensitive member on the intermediate transfer member, the Y toner, M toner, C toner and Bk toner are placed in large quantities corresponding to the color data of the original or CRT, so that the respective color toners are required to exhibit an extremely high transferability and the toner particles thereof are required to have shape factors SF-1 and SF-2 satisfying the above-mentioned conditions in order to realize such a high transferability.

Further, in order to faithfully reproduce minute latent image dots for realizing a high image quality, the toner particles may preferably have a weight-average particle size of 4–9 μm, more preferably 4–8 μm, and a variation coefficient of at most 35% based on the number-basis distribution. Toner particles having a weight-average particle size of below 4 μm are liable to cause a lowering in transfer efficiency to leave much transfer residual toner particles on the photosensitive member and the intermediate transfer member, and further result in image irregularities due to fog and transfer failure. Toner particles having a weight-average particle size in excess of 9 μm are liable to cause melt-sticking onto the photosensitive member surface and other members inclusive of the intermediate transfer member. The difficulties are promoted if the toner particles have a number-basis particle size variation coefficient ($A_{NV}$) in excess of 35% as calculated by the following formula:

$$\text{Variation coefficient } A_{NV}=[S/D_1]\times100,$$

wherein S denotes a standard deviation in number-basis particle size distribution, and D1 denotes a number-average particle size (diameter) (μm), respectively of toner particles.

Particle size distribution of toner particles may be measured according to various methods. For example, the Coulter counter method may be used.

For example, Coulter Counter TA-II or Coulter Multisizer (earl available from Coulter Electronics, Inc.) may be used as a measurement apparatus together with an interface for outputting a number-basis distribution and a volume-basis distribution (available from Nikkaki K.K.) and a personal computer connected thereto, and an electrolytic solution comprising ca. 1% NaCl aqueous solution which may be prepared by dissolving a reagent-grade sodium chloride or commercially available as "ISOTON-II" (from Coulter Scientific Japan). For measurement, into 100 to 150 ml of the electrolytic solution, 0.1 to 5 ml of a surfactant (preferably an alkylbenzenesulfonic acid salt) is added as a dispersant, and 2–20 mg of a measurement sample is added. The resultant dispersion of the sample in the electrolytic solution is subjected to a dispersion treatment by an ultrasonic disperser for ca. 1–3 min., and then subjected to measurement of particle size distribution by using, e.g., the above-mentioned Coulter Counter TA-II equipped with an, e.g., 100 $\mu$m-aperture to obtain a number-basis particle size distribution of particles of 2–40 $\mu$m. From the distribution, the weight-average particle size and the number-basis particle size variation coefficient may be derived.

Substantially identical measured values are obtained when toner particles alone are subjected to the measurement and when a toner containing an external additive in addition to the toner particles is subjected to the measurement since the weight and the number of the external additive having particle sizes of 2 $\mu$m or larger are very small compared with those of the toner particles.

The colorants usable in the present invention may include a yellow colorant, a magenta colorant, a cyan colorant, as may be selected from the groups of colorants described below, and also a black colorant which may comprise carbon black, a magnetic material, or a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and acrylamide compounds. Specific preferred examples thereof may include C.I. Pigment Yellow 12, 13, 14, 15, 17, 62, 74, 83, 93, 94, 95, 109, 110, 111, 128, 129, 147, 168, and 180.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, .185, 202, 206, 220, 221 and 254.

Examples of the cyan colorant may include: copper phthalocyanine compounds and their derivatives, anthraquinone compounds and basic dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the binder resin. A black colorant comprising a magnetic material, unlike the other colorants, may preferably be used in a proportion of 40–150 wt. parts per 100 wt. parts of the binder resin.

The toner according to the present invention can contain a charge control agent. The charge control agent may be a known one and may preferably be one having a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids such as salicylic acid, alkylsalicylic acid, dialkylsalicylic acid, naphtoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent used in the present invention may preferably be used in a proportion of 0.5–10 wt. parts per 100 wt. parts of the binder resin. However, the charge control agent is not an essential component for the toner particles used in the present invention. The charge control agent can be used as an optional additive in some cases. In the case of using two-component developing method, it is possible to utilize triboelectric charge with a carrier. In the case of using a non-magnetic one-component blade coating developing method, it is possible to omit a charge control agent by positively utilizing a triboelectric charge through friction with a blade member or a sleeve member.

As a process for producing a toner according to the present invention, there may be adopted a pulverization process wherein the binder resin, the colorant, the low-softening point substance and other optional additives such as a charge control agent and other internal additives are uniformly kneaded and dispersed by a pressure kneader, an extruder or a media disperser, and the kneaded product is mechanically pulverized or caused to impinge onto a target in a jet stream to be pulverized into a desired toner particle size level, followed optionally by a step of smoothing and sphering the pulverized particles and then by classification into a narrower particle size distribution to form toner particles. In addition, it is also possible to adopt a process for obtaining spherical toner particles by spraying a molten mixture into air by using a disk or a multi-fluid nozzle as disclosed in JP-B 56-13945, etc.; a process for directly producing toner particles according to suspension polymerization as disclosed in JP-B 36-10231, JP-A 59-53856, and JP-A 59-61842; a dispersion polymerization process for directly producing toner particles in an aqueous organic solvent in which the monomer is soluble but the resultant polymer is insoluble; and a process for producing toner particles according to emulsion polymerization as represented by soap-free polymerization wherein toner particles are directly formed by polymerization in the presence of a water-soluble polymerization initiator.

According to the pulverization process for toner production, it is difficult to obtain toner particles having shape factors SF-1 and SF-2 in the prescribed ranges, and according to the melt-spraying process, the resultant toner particles are liable to have a broad particle size distribution even if they have an SF-1 value in the range of 100–160. On the other hand, the dispersion polymerization process provides toner particles having an extremely sharp particle size distribution but allows only a narrow latitude for selection of usable materials, and the use of an organic solvent requires a complicated production apparatus and troublesome operations accompanying the disposal of a waste solvent and inflammability of the solvent. The emulsion polymerization process as represented by the soap-free polymerization is effective for providing toner particles having a relatively narrow particle size distribution, but the used emulsifier and polymerization initiator terminal are liable to be present at the toner particle surfaces, thus resulting in an inferior environmental characteristic.

For the purpose of the present invention, it is preferred to adopt the emulsion polymerization process or the suspension polymerization process, under the normal or elevated pressure, capable of relatively easily providing toner particles of 4–9 $\mu$m having a shape factor SF-1 of 100–160 and a sharp particle size distribution. It is also possible to apply the preliminarily obtained polymerizate particles to a shape-adjusting treatment with media or by direct impingement onto a collision plate, or to coalescence of the polymerizate particles by freezing, salting-out or coagulation with particles having an opposite-polarity surface charge under a controlled pH in an aqueous medium. It is also possible to adopt a seed polymerization process wherein a monomer is further adsorbed onto once-obtained polymerizate particles and polymerized by using a polymerization initiator.

In the case of producing toner particles through a direct polymerization process wherein droplets of a polymerizable monomer composition are polymerized in an aqueous medium, it is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium.

In the toner production by direct polymerization, examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobis-isobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while referring to their 10-hour half-life temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may be produced by direct polymerization in the following manner. Into a vinyl monomer, a colorant, a reactive polyester and a wax, and optionally a charge control agent, a polymerization initiator and another optional additive are added and uniformly dissolved or dispersed to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a latter stage of the polymerization. It is also possible to subject a part of the aqueous system to distillation in a latter stage of or after the polymerization in order to remove the yet-unpolymerized part of the polymerizable monomer and a by-product which can cause and odor in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

In order to produce the toner particles with little fluctuation in contents of the components A, B and C among individual toner particles, it is preferred to disperse a polymerizable monomer composition comprising at least a vinyl monomer, an unsaturated polyester, a colorant and a wax into an aqueous medium to form particles (or droplets) of the polymerizable monomer composition, and then polymerize the vinyl monomer in the composition, to produce toner particles. As the vinyl monomer, it is preferred to use styrene monomer, an acrylate ester or a methacrylate ester, and particularly a combination of styrene monomer and an acrylate ester and/or a methacrylate ester so as to provide a glass transition point of 40–75° C.

The unsaturated polyester in the polymerizable monomer composition tends to be localized at the surface of the particles of the polymerizable monomer composition dispersed in the aqueous medium because of its carboxyl group and hydroxyl group. The unsaturated polyester localized at the surface of the particles is reacted with the vinyl monomer to form the components B and C, thus providing toner particles wherein the surface portion is composed of the component B having molecular weights of at least $10^6$ and/or the component C having an increased molecular weight so as to be THF-insoluble, and the inner portion is composed of the component A enclosing the wax. As a result, it is possible to effectively produce toner particles having strong resistance to wearing and impact, having an excellent continuous image performance on a large number of sheets, and also excellent in anti-high-temperature offset characteristic and low temperature fixability. In order to adjust a ratio between the components B and C, it is also preferred to incorporate a crosslinking agent, such as divinylbenzene, in the polymerizable monomer composition in a proportion of 0.01–2.5 wt. parts, more preferably 0.05–1.0 wt. part, per 100 wt. parts of the vinyl monomer. The thus-formed toner particles may be provided with a hybrid component comprising a vinyl polymer unit and a polyester unit bonded to each other localized at the surface of the toner particles. In order to provide such a hybrid component localized at the toner particle surface, the unsaturated polyester may preferably have a weight-average molecular weight of $3\times10^3$–$10^5$, more preferably $3\times10^3$–$3\times10^4$, and an acid value of 2–20 mgKOH/g and may preferably be in the form of a linear polyester.

The toner particles may preferably be blended with hydrophobic silica fine powder, hydrophobic titanium oxide fine powder or hydrophobic alumina fine powder each having a BET specific surface area of 50–400 $m^2/g$ externally blended thereto in a proportion of 0.1–4.0 wt. parts per 100 wt. parts of the toner particles, so as to exhibit improved flowability and environmental stability.

An image forming method to which the toner according to the present invention is applicable will now be described with reference to FIGS. 3 and 4.

Referring to FIG. 3, an image forming apparatus principally includes a photosensitive member 1 as an electrostatic image-bearing member, a charging roller 2 as a charging means, a developing device 4 comprising four developing units 4-1, 4-2, 4-3 and 4-4, an intermediate transfer member 5, a transfer roller 7 as a transfer means, and a fixing device H as a fixing means.

Four developers comprising cyan toner particles, magenta toner particles, yellow toner particles, and black toner particles are incorporated in the developing units 4-1 to 4-4. An electrostatic image is formed on the photosensitive member 1 and developed with the four color toner particles by a developing method such as a magnetic brush developing system or a non-magnetic monocomponent developing system, whereby the respective toner images are formed on the photosensitive member 1.

Figure 4:
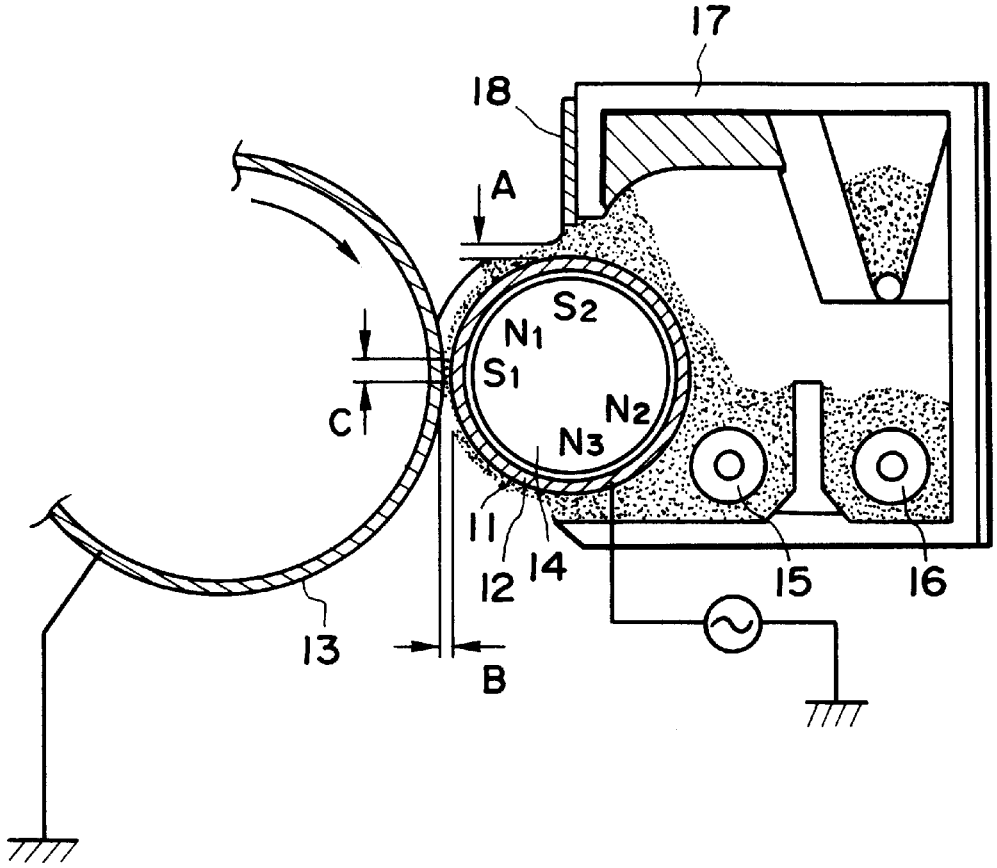
FIG. 4 is an enlarged sectional view of a developing apparatus using a two-component type developer used in an embodiment of the invention.

A non-magnetic toner according to the present invention may be blended with a magnetic carrier and may be used for development by using a developing means as shown in FIG. 4. It is preferred to effect a development in a state where a magnetic brush contacts a latent image-bearing member, e.g., a photosensitive drum 13 under application of an alternating electric field. A developer-carrying member (developing sleeve) 11 may preferably be disposed to provide a gap B of 100–1000 $\mu$m from the photosensitive drum 13 in order to prevent the toner attachment and improve the dot reproducibility. If the gap is narrower than 100 $\mu$m, the supply of the developer is liable to be insufficient to result in a low image density. In excess of 1000 $\mu$m, the lines of magnetic force exerted by a developing pole Sl is spread to provide a low density of magnetic brush, thus being liable to result in an inferior dot reproducibility and a weak carrier constraint force leading to carrier attachment.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 11 with the photosensitive drum 13 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 18 and the developing sleeve 11 and/or changing the gap B between the developing sleeve 11 and the photosensitive drum 13.

In formation of a full color image for which a halftone reproducibility is a great concern may be performed by using at least 3 developing devices for magenta, cyan and yellow, adopting the toner according to the present invention and preferably adopting a developing system for developing digital latent images in combination, whereby a development faithful to a dot latent image becomes possible while avoiding an adverse effect of the magnetic brush and disturbance of the latent image. The use of the toner according to the present invention is also effective in realizing a high transfer ratio in a subsequent transfer step. As a result, it becomes possible to obtain high image qualities both at the halftone portion and the solid image portion.

In addition to the high image quality at an initial stage of image formation, the use of the toner according to the present invention is also effective in avoiding the lowering in image quality in a continuous image formation on a large number of sheets.

Figure 5:
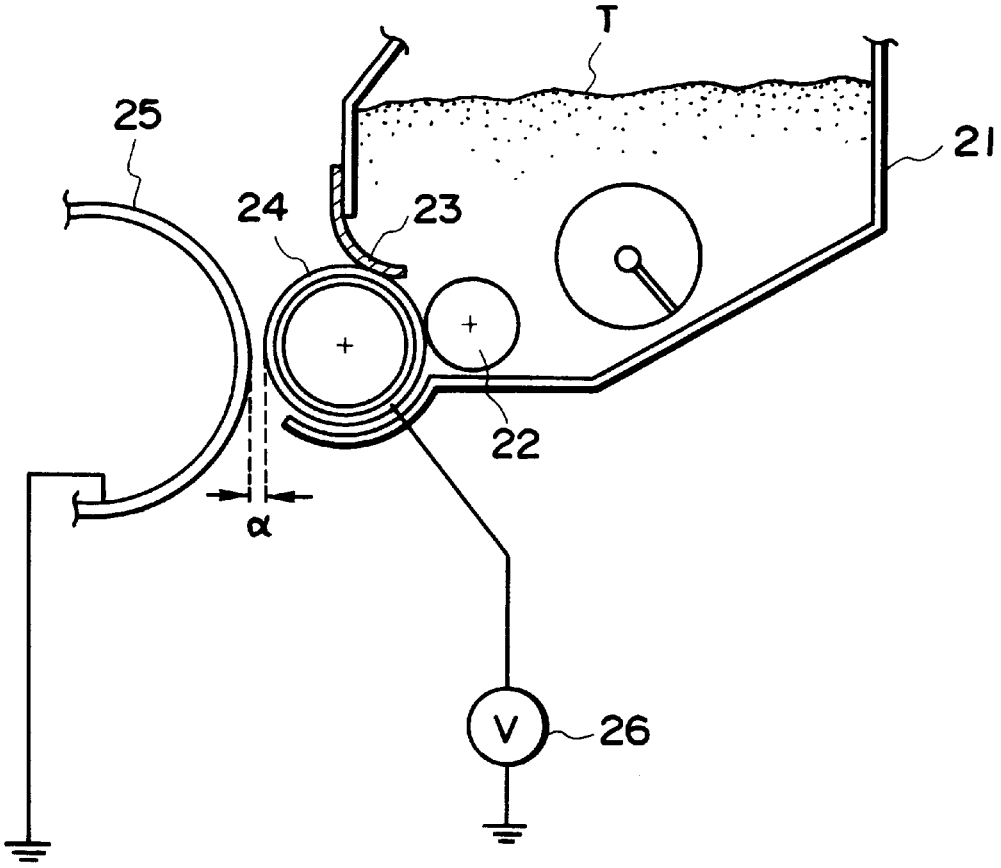
FIG. 5 is an enlarged sectional view of a developing apparatus using a mono-component type developer used in an embodiment of the invention.

The toner according to the present invention may also be realized as a non-magnetic or magnetic toner for a monocomponent development method. FIG. 5 illustrates an example for such a development apparatus.

Referring to FIG. 5, an electrostatic image formed on an electrostatic image-bearing member 25 by electrophotography or electrostatic recording may be developed with a toner T contained in a toner vessel 21 and applied on a non-magnetic developing sleeve (toner-carrying member) 24 comprising aluminum or stainless steel.

Almost a right half circumference of the developing sleeve is caused to always contact the toner T stored in the toner vessel 21, and the toner in proximity to the developing sleeve 24 is attached to and carried on the developing sleeve 24 under the action of a magnetic force generated by a magnetic field-generating means in the developing sleeve and/or an electrostatic force.

The toner carrying member 24 may have a surface roughness Ra set to 1.5 $\mu$m or smaller, preferably 1.0 $\mu$m or smaller, further preferably 0.5 $\mu$m or smaller.

By setting the surface roughness Ra to at most 1.5 $\mu$m, the toner particle-conveying force of the toner carrying member is suppressed to allow the formation of a thin toner layer on the toner-carrying member and increase the number of contents between the toner carrying member and the toner, to thereby improve the toner chargeability.

In case where the surface roughness Ra of the toner carrying member exceeds 1.5, it become difficult to form a thin layer of toner on the toner carrying member and improve the toner chargeability, so that the improvement in image quality becomes difficult to realize.

The surface roughness Ra of the toner carrying member refers to a center line-average roughness as measured by a surface roughness tester ("Surfcoder SE-30H", available from K.K. Kosaka Kenkyusho) according to JIS B0601. More specifically, the surface roughness Ra may be determined by taking a measurement length a of 2.5 mm along a center lien (taken on an x-axis) and taking a roughness on a y-axis direction to represent the roughness curve by a function of y=f(x) to calculate a surface roughness Ra ($\mu$m) from the following equation:

$$Ra=(1/a)\int_0^a|f(x)|dx.$$

The toner-carrying member may preferably comprise a cylinder or a belt of stainless steel, aluminum, etc., which may be surface-coated with a metal, a resin, or a resin containing fine particles of a resin, a metal, carbon black or a charge control agent.

If the surface-moving velocity of the toner-carrying member is set to be 1.05–3.0 times the surface moving speed of the electrostatic image-bearing member, the toner layer on the toner-carrying member receives an appropriate degree of stirring effect to realize a better faithful reproduction of an electrostatic image.

If the surface speed of the toner carrying member is below 1.05 times that of the electrostatic image-bearing member, such a toner layer stirring effect is insufficient, so that it becomes difficult to expect a good image formation. Further, in the case of forming a solid image requiring a large amount of toner over a wide area, the toner supply to the electrostatic image is liable to be insufficient to result in a lower image density. On the other hand, in excess of 3.0, the toner is liable to be excessively charged and cause difficulties, such as toner deterioration or sticking onto the toner-carrying member (developing sleeve).

The toner T stored in the hopper (toner vessel) 21 is supplied to the developing sleeve 24 by means of a supply member 22. The supply member may preferably be in the form of a supply roller comprising a porous elastic material or a foam material, such as soft polyurethane foam. The supply roller 22 is rotated at a non-zero relative velocity in a forward or reverse direction with respect to the developing sleeve, whereby the peeling of the toner (a portion of the toner not used for development) from the developing sleeve simultaneously with the toner supply to the developing sleeve. In view of the balance between the toner supply and toner peeling, the supply roller 22 may preferably be abutted to the developing sleeve in a width of 2.0–10.0 mm, more preferably 4.0–6.0 mm. On the other hand, a large stress is liable to be applied to the toner to promote the toner deterioration or agglomeration or melt-sticking of the toner onto the developing sleeve and the supply roller, but, as the toner according to the present invention is excellent in flowability, releasability and durability, so that the toner is suitably used in the developing method using such a supply roller. The supply member can also comprise a brush member of resinous fiber of, e.g., nylon or rayon. The use of such a supply member is very effective for a non-magnetic monocomponent toner not capable of utilizing a magnetic constraint forth for toner application but can also be applicable to a monocomponent development method using a magnetic monocomponent method.

The toner supplied to the developing sleeve can be applied uniformly in a thin layer by a regulation member. The thin toner layer-regulating member may comprise a doctor blade, such as a metal blade or a magnetic blade, disposed with a certain gap from the developing sleeve, or alternatively may comprise a rigid roller or a sleeve of a metal, a resin or a ceramic material, optionally including therein a magnetic field generating means.

Alternatively, it is also possible to constitute such a thin toner layer-regulating member as an elastic member, such as an elastic blade or an elastic roller, for applying a toner under pressure. FIG. 5, for example, shows an elastic blade 23 fixed at its upper but root portion to the developer vessel 21 and having its lower free length portion pressed at an appropriate pressure against the developing sleeve so as to extend in a reverse direction (as shown or in a forward direction). By using such an application means, it becomes possible to form a tight toner layer stable against an environmental change. The mechanism thereof has not been fully clarified as yet, but it is assumed that the forcible triboelectrification with the developing sleeve surface due to the elastic member allows a constant state charging regardless of a change in toner behavior accompanying an environmental change.

On the other hand, the use of such an elastic blade is liable to cause an excessive charge and a toner melt-sticking onto the developing sleeve or the elastic blade, but the toner of the present invention is suitably used because of excellent releasability and stable triboelectric chargeability.

The elastic material may preferably comprise a material having an appropriate chargeability position in a triboelectric chargeability series so as to charge the toner to an appropriate polarity and may for example comprise: an elastomer, such as silicone rubber, urethane rubber or NBR; an elastic synthetic resin, such as polyethylene terephthalate; an elastic metal, such as stainless steel, steel and phosphor bronze; or a composite material of these.

In the case of providing a durable elastic member, it is preferred to use a laminate of an elastic metal and a resin or rubber or use a coated member.

Further, the elastic material can contain an organic material or an inorganic material added thereto, e.g., by melt-mixing or dispersion. For example, by adding a metal oxide, a metal powder, a ceramic, carbon allotrope, whisker, inorganic fiber, dye, pigment or a surfactant, the toner chargeability can be controlled. Particularly, in the case of using an elastic member formed of a rubber or a resin, it is preferred to add fine powder of a metal oxide, such as silica, alumina, titania, tin oxide, zirconia oxide or zinc oxide; carbon black; or a charge control agent generally used in toners.

Further, by applying a DC and/or AC electric field to the blade regulation member, or the supply roller or brush member, it becomes possible to exert a disintegration action onto the toner layer, particularly enhance the uniform thin layer application performance and uniform chargeability at the regulating position, and the toner supply/peeling position at the supply position, thereby providing increased image density and better image quality.

The elastic member may be abutted against the toner-carrying member at an abutting pressure of at least 0.1 kg/m, preferably 0.3–25 kg/m, further preferably 0.5–12 kg/m, in terms of a linear pressure in the direction of a generatrix of the toner-carrying member. As a result, it becomes possible to effectively disintegrate the toner to realize a quick charging of the toner. If the abutting pressure is below 0.1 kg/m, the uniform toner application becomes difficult to result in a broad toner charge distribution leading to fog and scattering. Above 25 kg/m, an excessive pressure is applied to the toner to cause toner deterioration or toner agglomeration, and a large torque becomes necessary for driving the toner-carrying member.

It is preferred to dispose the electrostatic image-bearing member 25 and the toner-carrying member 24 with a gap $\alpha$ of 50–500 $\mu$m, and a doctor blade may disposed with a gap of 50–400 $\mu$m from the toner-carrying member.

It is generally most preferred that the toner layer thickness is set to be thinner than the gap between the electrostatic image-bearing member and the toner carrying member, but the toner layer thickness can be set so that a portion of toner ears constituting the toner layer contacts the electrostatic image-bearing member.

Further, by forming an alternating electric field between the electrostatic image-bearing member and the toner-carrying member from a bias voltage supply 26, it becomes possible to facilitate the toner movement from the toner-carrying member to the electrostatic image-bearing member, thereby providing a better quality of images. The alternating electric field may comprise a peak-to-peak voltage Vpp of at least 100 volts, preferably 200–3000 volts, further preferably 300–2000 volts, and a frequency f of 500–5000 Hz, preferably 1000–3000 Hz, further preferably 1500–3000 Hz. The alternating electric field may comprise a waveform of a rectangular wave, a sinusoidal wave, a sawteeth wave or a triangular wave. Further, it is also possible to apply an asymmetrical AC bias electric field having a positive wave portion and a negative wave portion having different voltages and durations. It is also preferred to superpose a DC bias component.

Referring again to FIG. 3, the electrostatic image-bearing member 1 may comprise a photosensitive drum (or a photosensitive belt) comprising a layer of a photoconductive insulating material, such as a-Se, CdS, $ZnO_2$, OPC (organic photoconductor), and a-Si (amorphous silicon). The electrostatic image-bearing member 1 may preferably comprise an a-Si photosensitive layer or OPC photosensitive layer.

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

A charging step may be performed by using a corona charger which is not in contact with the photosensitive member 1 or by using a contact charger, such as a charging roller. The contact charging system as shown in FIG. 3 may preferably be used in view of efficiency of uniform charging, simplicity and a lower ozone-generating characteristic.

The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated mating with the rotation of the photosensitive member 1.

The charging step using the charging roller may preferably be performed under process conditions including an applied pressure of the roller of 5–500 g/cm, an AC voltage of 0.5–5 kVpp, an AC frequency of 50–5 kHz and a DC voltage of ±0.2–±1.5 kV in the case of applying AC voltage and DC voltage in superposition; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing the occurrence of ozone. The charging roller and charging blade each used as a contact charging means may preferably comprise an electroconductive rubber and may optionally comprise a releasing film on the surface thereof. The releasing film may comprise, e.g., a nylon-based resin, polyvinylidene fluoride (PVDF) or polyvinylidene chloride (PVDC).

The toner image formed on the electrostatic image-bearing member 1 is transferred to an intermediate transfer members 5 to which a voltage (e.g., ±0.1–±5 kV) is applied. The surface of the electrostatic image-bearing member may then be cleaned by cleaning means 9 including a cleaning blade 8.

The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* can comprise a plastic pipe coated by electroconductive plating. The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm, particularly $10^7$–$10^{10}$ ohm.cm. The intermediate transfer member 5 is disposed under the electrostatic image-bearing member 1 so that it has an axis (or a shaft) disposed in parallel with that of the electrostatic image-bearing member 1 and is in contact with the electrostatic image-bearing member 1. The intermediate transfer member 5 is rotated in the direction of an arrow (counterclockwise direction) at a peripheral speed identical to that of the electrostatic image-bearing member 1.

The respective color toner images are successively intermediately transferred to the peripheral surface of the intermediate transfer member 5 by an elastic field formed by applying a transfer bias to a transfer nip region between the electrostatic image-bearing member 1 and the intermediate transfer member 5 at the time of passing through the transfer nip region.

After the intermediate transfer of the respective toner image, the surface of the intermediate transfer member 5 is cleaned, as desired, by a cleaning means which can be attached to or detached from the image forming apparatus. In case where the toner image is placed on the intermediate transfer member 5, the cleaning means is detached or released from the surface of the intermediate transfer member 5 so as not to disturb the toner image.

The transfer means (e.g., a transfer roller) 7 is disposed under the intermediate transfer member 5 so that it has an axis (or a shaft) disposed in parallel with that of the intermediate transfer member 5 and is in contact with the intermediate transfer member 5. The transfer means (roller) 7 is rotated in the direction of an arrow (clockwise direction) at a peripheral speed identical to that of the intermediate transfer member 5. The transfer roller 7 may be disposed so that it is directly in contact with the intermediate transfer member 5 or in contact with the intermediate transfer member 5 via a belt, etc. The transfer roller 7 may comprise an electroconductive elastic layer 7*a* disposed on a peripheral surface of a core metal 7*b*.

The intermediate transfer member 5 and the transfer roller 7 may comprise known materials as generally used. By setting the volume resistivity of the elastic layer 5*a* of the intermediate transfer member 5 to be higher than that of the elastic layer 7*b* of the transfer roller, it is possible to alleviate a voltage applied to the transfer roller 7. As a result, a good toner image is formed on the transfer-receiving material and the transfer-receiving material is prevented from winding about the intermediate transfer member 5. The elastic layer 5*a* of the intermediate transfer member 5 may preferably have a volume resistivity at least ten times that of the elastic layer 7*b* of the transfer roller 7.

The transfer roller 7 may comprise a core metal 7*b* and an electroconductive elastic layer 7*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 7*b* by a constant-voltage supply.

The toner according to the present invention exhibits a high transfer efficiency in the transfer steps to leave little transfer residual toner and also exhibits excellent cleanability, so that it does not readily cause filming on the electrostatic image-bearing member. Further, even when subjected to a continuous image formation test on a large number of sheets, the toner according to the present invention allows little embedding of the external additive at the toner particle surface, so that it can provide a good image quality for a long period. Particularly, the toner according to the present invention can be suitably used in an image forming apparatus equipped with a re-use mechanism wherein the transfer residual toner on the electrostatic image-bearing member and the intermediate transfer member is recovered and re-used for image formation.

Figure 6:
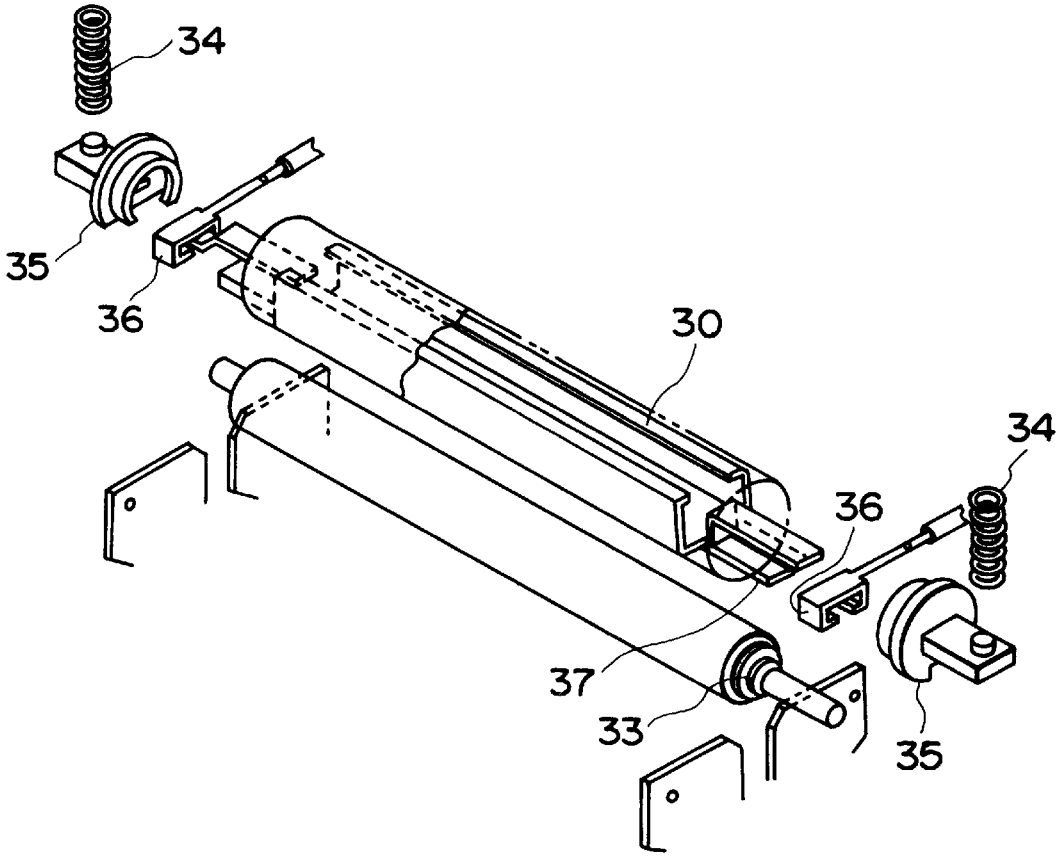
FIG. 6 is an exploded perspective view of essential parts of a heat-pressure fixing apparatus used in an embodiment of the invention.
Figure 7:
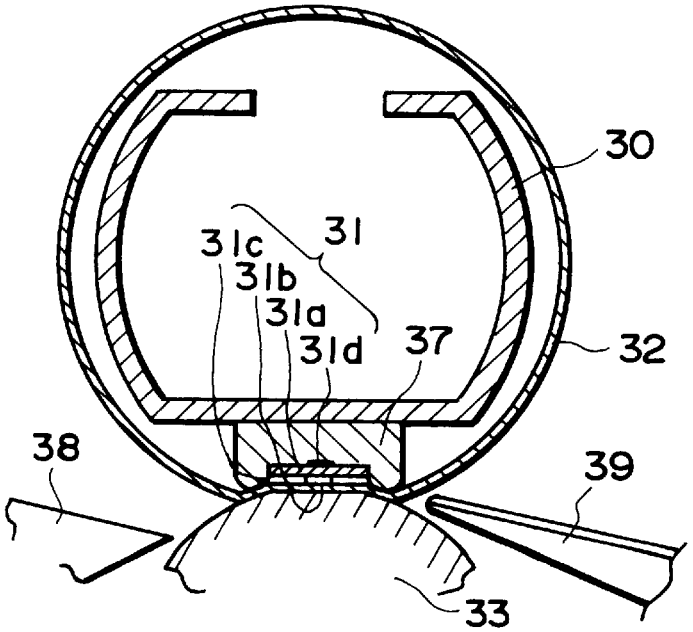
FIG. 7 is an enlarged sectional view of the fixing apparatus including a film in a non-driven state.

The transfer-receiving material 6 carrying the transferred toner image is then conveyed to heat-pressure fixation means, inclusive of a hot roller fixation device comprising basically a heating roller enclosing a heat-generating member, such as a halogen heater, and a pressure roller comprising an elastic material pressed against the heating roller, and a hot fixation device for fixation by heating via a film (as shown in FIGS. 6 and 7, wherein reference numeral 30 denotes a stay; 31, a heating member; 31*a*, a heater substrate; 31*b*, a heat-generating member; 31*c*, a surface protective layer; 31*d*, a temperature-detecting element; 32, a fixing film; 33, a pressing roller; 34, a coil spring; 35, a film edge-regulating member; 36, an electricity-supplying connector; 37, an electricity interrupting member; 38, an inlet guide; and 39, an outlet guide (separation guide). As the toner according to the present invention has excellent fixability and anti-offset characteristic, the toner is suitably used in combination with such a heat-pressure fixation device.

Hereinbelow, the present invention will be described more specifically based on Examples.

EXAMPLE 1

A mixture was prepared by sufficiently mixing and dispersing 132 wt. parts of styrene, 68 wt. parts of n-butyl acrylate, 0.91 wt. part of divinylbenzene (purity=55%), 4.0 wt. parts of a linear unsaturated polyester shown below, 20 wt. parts of paraffin wax (Heat-absorption main peak temperature ($T_{HAP}$)=75° C., number-average molecular weight (Mn)=830), 15 wt. parts of carbon black (BET specific surface area ($S_{BET}$)=60 $m^2$/g, oil absorption=115 ml/g), and 4.0 wt. parts of a negative charge control agent (di-tert-butylsalicylic acid iron complex) by means of an attritor (available from Mitsui Miike Kohki K.K.)

<Linear Unsaturated Polyester>

(a) Polycondensate of fumaric acid and bisphenol A derivative as shown below:

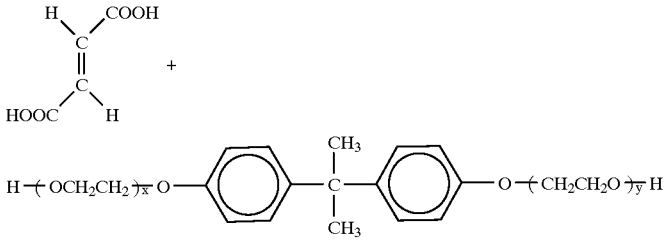

(x + y = ca. 2)

(b) Weight-average molecular weight (Mw)=$10^4$ (c) Acid value (A.V.)=10 (mgKOH/g)

Further, 2 wt. parts of 2,2'-azobis(2,4-dimethylvaleronitrile) was added to and stirred sufficiently together with the above-prepared mixture to form a polymerizable monomer composition.

Separately, into a four-necked vessel equipped with a high-speed stirrer ("TK-Homomixer", available from Tokushu Kika Kogyo K.K.), 500 wt. parts of deionized water and 650 wt. parts of 0.1M–$Na_3PO_4$ aqueous solution were placed and warmed at 70° C. Further, 100 wt. parts of 1.0M–$CaCl_2$ aqueous solution was added thereto, and the mixture was stirred at 10,000 rpm to form an aqueous dispersion medium containing finely dispersed hardly water-soluble dispersion stabilizer $Ca_3(PO_4)_2$.

The above-prepared polymerizable monomer composition was charged into the aqueous dispersion medium and stirred at 10,000 rpm for 7 min. at 70° C. under a nitrogen gas stream to form particles of the monomer composition. Then, the stirrer was replaced by a paddle stirrer, and the system was subjected to polymerization for 5 hours at 70° C. and then for 5 hours at 80° C.

After the polymerization, the content in the vessel was cooled to room temperature, and hydrochloric acid was added thereto to dissolve the dispersion stabilizer, followed by recovering by filtration, washing with water and drying of the polymerizate to obtain Toner particles (A), which exhibited a cross-sectional view as shown in FIG. 2A wherein the wax was dispersed in the form of a substantially spherical particle 22 without being dissolved in the matrix binder resin 21. Further, each toner particle showed a surface layer of the localized polyester.

Toner particles (A) comprised ca. 10 wt. parts of the paraffin wax, ca 7.5 wt. parts of the carbon black and ca. 2 wt. parts of the negative charge control agent per 100 wt. parts of binder resin comprising styrene-n-butyl acrylate copolymer and unsaturated polyester crosslinked with divinylbenzene. The unsaturated polyester was reacted with the styrene and n-butyl acrylate to form a hybrid component.

The properties of Toner particles (A) are shown in Table 1 appearing hereinafter together with those of toner particles obtained in Examples and Comparative Examples described hereinafter.

100 wt. parts of Toner particles (A) were blended with 2.0 wt. parts of hydrophobic silica fine powder ($S_{BET}$=200 $m^2/g$) to form Toner (A) according to the present invention. Further, 6 wt. parts of Toner (A) was blended with 94 wt. parts of silicone resin-coated magnetic ferrite carrier (average particle size (Dav)=50 $\mu$m) to prepare Developer (A) of two-component type for magnetic brush development.

EXAMPLE 2

Toner particles (B) were prepared in the same manner as in Example 1 except for using a polymerizable monomer composition prepared by further adding 4 wt. parts of a saturated polyester shown below to the polymerizable monomer composition of Example 1.

<Saturated Polyester>

(a) Polycondensate of terephthalic acid and bisphenol A derivative as shown below:

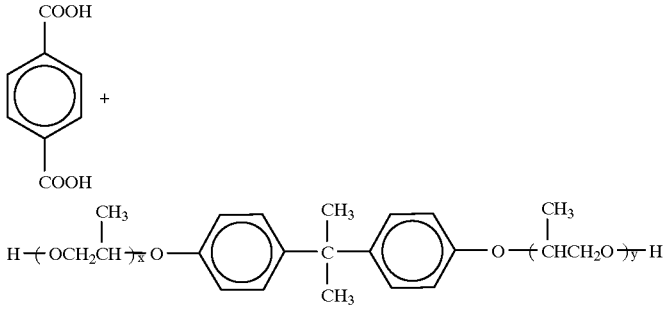

(x + y = ca. 2)

(b) Mw=$1.1\times10^4$ (c) A.V.=12 (mgKOH/g)

Further, Toner (B) and Developer (B) were prepared similarly as in Example 1 except for using Toner particles (B) instead of Toner particles (A).

EXAMPLE 3

Toner particles (C), Toner (C) and Developer (C) were prepared in the same manner as in Example 2 except that the amount of the saturated polyester was changed to 10 wt. parts, and the amount of the divinylbenzene (purity: 55%) was changed to 0.30 wt. part.

EXAMPLE 4

Toner particles (D), Toner (D) and Developer (D) were prepared in the same manner as in Example 3 except for changing the amounts of the unsaturated polyester and the saturated polyester were changed to 5 wt. parts and 15 wt. parts, respectively.

EXAMPLE 5

Toner particles (E), Toner (E) and Developer (E) were prepared in the same manner as in Example 3 except for changing the amounts of the unsaturated polyester and the saturated polyester were changed to 6 wt. parts and 20 wt. parts, respectively.

EXAMPLE 6

Toner particles (F), Toner (F) and Developer (F) were prepared in the same manner as in Example 1 except that the amount of the divinylbenzene (purity: 55%) was changed to 1.80 wt. parts and the polymerization was effected for 10 hours at 60° C.

COMPARATIVE EXAMPLE 1

Comparative Toner particles (G), Comparative Toner (G) and Comparative Developer (G) were prepared in the same manner as in Example 2 except that the unsaturated polyester was omitted and the amount of the saturated polyester was changed to 20 wt. parts.

COMPARATIVE EXAMPLE 2

Comparative Toner particles (H), Comparative Toner (H) and Comparative Developer (H) were prepared in the same manner as in Example 1 except that the amounts of the divinylbenzene (55%) and 2,2'-azobis(2,4-dimethylvaleronitrile) to 5.0 wt. parts and 2.0 wt. parts, respectively, and the polymerization was performed for 5 hours at 50° C. and 5 hours at 60° C.

COMPARATIVE EXAMPLE 3

Styrene-butyl acrylate copolymer 100 wt. parts (peak molecular weight (Mp)=$2.0\times10^4$, Mw=$3.2\times10^4$, Mw/Mn=1.8, Tg=59° C.)

Unsaturated polyester used in Example 1 2 wt. parts

Carbon black used in Example 1 7.5 wt. parts

Negative charge control agent used in Example 1 2 wt. parts

Paraffin wax used in Example 1 10 wt. parts

The above ingredients were melt-kneaded through a twin-screw extruder, and the kneaded product after cooling was coarsely crushed by a hammer mill, followed by pulverization by a jet mill and classification to prepare Comparative Toner particles (I), from which Comparative Toner (I) and Comparative Developer (I) were prepared otherwise in the same manner as in Example 1.

Comparative Toner particles (I) exhibited a finely dispersed state of wax particles 22 similarly as shown in FIG. 2B, and also the presence of wax at the toner particle surface.

The properties, particle size distribution shape factors and results of TEM observation for the toner particles prepared in the above-described Examples and Comparative Examples are inclusively shown in the following Tables 1–3.

TABLE 1

| | Composition of binder resins | | | | | | | |
|---|---|---|---|---|---|---|---|---|
| | | | | | | Molecular weight distribution of THF-soluble content | | |
| | Contents of Components A, B & C | | | | | Components | Components | Components |
| Toner particles | A (wt. %) | B (wt. %) | C (wt. %) | B + C (wt. %) | Mp ($\times10^4$) | of $\leqq5\times10^4$ (%) | of $5\times10^4$–$10^6$ (%) | of $\geqq10^6$ (%) |
| (A) | 54 | 6 | 40 | 46 | 1.8 | 67 | 23 | 10 |
| (B) | 62 | 3 | 35 | 38 | 2.2 | 57 | 38 | 5 |
| (C) | 91 | 4 | 5 | 9 | 1.3 | 57 | 39 | 4 |
| (D) | 85 | 5 | 10 | 15 | 1.4 | 66 | 28 | 6 |
| (E) | 79 | 6 | 15 | 21 | 1.3 | 65 | 30 | 7 |
| (F) | 42 | 6 | 52 | 58 | 4.5 | 43 | 44 | 13 |
| Comp. | | | | | | | | |
| (G) | ca. 35 | <0.1 | 65 | ca. 65 | 1.2 | 81 | 19 | <0.1 |
| (H) | 29 | 6 | 65 | 71 | 5.5 | 33 | 50 | 17 |
| (I) | ca. 10.0 | <0.1 | 0 | ca. 0 | 1.9 | 81 | 19 | <0.1 |

TABLE 2

| | Characterization of Components A, B and C in the binder resin | | | | | | |
|---|---|---|---|---|---|---|---|
| | Component B | | Component C | | Component A | | |
| Toner particles | Polyester in B (wt. %) | Polyester based on binder (wt. %) | Polyester in C (wt. %) | Polyester based on binder (wt. %) | Polyester in A (wt. %) | Polyester based on binder (wt. %) | Vinyl polymer in A (wt. %) |
| (A) | 23 | 1.4 | 1.5 | 0.6 | 0.01 | ca.0 | ≧99 |
| (B) | 50 | 1.5 | 1.4 | 0.5 | 3.2 | 2.0 | 96.8 |
| (C) | 23 | 0.9 | 20 | 1.0 | 5.2 | 4.7 | 94.8 |
| (D) | 26 | 1.3 | 10 | 1.0 | 8.0 | 6.8 | 92.0 |
| (E) | 28 | 1.7 | 6.7 | 1.0 | 11.1 | 8.8 | 88.9 |
| (F) | 13 | 0.8 | 2.5 | 1.2 | <0.01 | ca.0 | ≧99 |
| Comp. | | | | | | | |
| (G) | <0.01 | ca.0 | <0.01 | ca.0 | 26 | 9.1 | 74 |
| (H) | 1 | 0.3 | 2.6 | 1.7 | <0.01 | ca.0 | ≧99 |
| (I) | <0.01 | ca.0 | <0.01 | 0 | 2.0 | 2.0 | 98 |

TABLE 3

| Toner particles | Shape factors SF-1 | SF-2 | SF-2/SF-1 | Particle size distribution* $D_4$ (μm) | $A_{NV}$ (%) | Wax dispersion state (TEM) |
|---|---|---|---|---|---|---|
| (A) | 125 | 112 | 0.90 | 6.3 | 26 | spherical |
| (B) | 123 | 106 | 0.86 | 6.4 | 28 | spherical |
| (C) | 130 | 115 | 0.88 | 6.7 | 29 | spherical |
| (D) | 133 | 115 | 0.86 | 6.5 | 28 | spheroidal |
| (E) | 135 | 114 | 0.84 | 6.2 | 27 | spheroidal |
| (F) | 127 | 118 | 0.93 | 6.8 | 30 | spheroidal |
| Comp. | | | | | | |
| (G) | 133 | 127 | 0.95 | 6.2 | 25 | spherical |
| (H) | 115 | 107 | 0.93 | 6.2 | 23 | spherical |
| (I) | 165 | 142 | 0.86 | 10.2 | 32 | fine dispersion |

*: $D_4$: weight-average particle size
$A_{NV}$: number-basis particle size variation coefficient (= S/D1 × 100, s: standard deviation, D1 = number-average particle size.

EXAMPLES 7–12 AND COMPARATIVE EXAMPLES 4–6

Each of the developers prepared in the above-described Examples 1–6 and Comparative Examples 1–3 was charged in a black developing unit 4-4 in a full-color image forming apparatus as shown in FIG. 3 and subjected to a black single color-mode image forming test. First of all, the outline of the image forming apparatus is explained.

Referring to FIG. 3, a photosensitive member 1 comprising a support 1*a* and a photosensitive layer 1*b* disposed thereon containing an organic photosemiconductor was rotated in the direction of an arrow and charged so as to have a surface potential of about −600 V by a charging roller 2 (comprising an electroconductive elastic layer 2*a* and a core metal 2*b*). An electrostatic image having a light (exposed) part potential of −100 V and a dark part potential of −600 V was formed on the photosensitive member 1 by exposing the photosensitive member 1 to light-image by using an image exposure means effecting ON and OFF based on digital image information through a polygonal mirror. The electrostatic image was developed with black toner particles contained in a developing unit 4-4 according to the reversal development mode to form a black toner image on the photosensitive member 1. The black color toner images thus formed was transferred to an intermediate transfer member 5 (comprising an elastic layer 5*a* and a core metal 5*b* as a support) to form thereon a superposed four-color image. Residual toner particles on the photosensitive member 1 after the transfer were recovered by a cleaning member 8 to be contained in a residual toner container 9.

The intermediate transfer member 5 was formed by applying a coating liquid for the elastic layer 5*a* comprising carbon black (as an electroconductivity-imparting material) sufficiently dispersed in acrylonitrile-butadiene rubber (NBR) onto a pipe-like core metal 5*b*. The elastic layer 5*a* of the intermediate transfer member 105 showed a hardness of 30 degrees as measured by JIS K-6301 and a volume resistivity (Rv) of $10^9$ ohm.cm. The transfer from the photosensitive member 1 to the intermediate transfer member 5 was performed by applying a voltage of +500 V from a power supply to the core metal 5*b* to provide a necessary transfer current of about 5 μA.

The transfer roller 7 had a diameter of 20 mm and was formed by applying a coating liquid for the elastic layer 7*a* comprising carbon (as an electroconductivity-imparting material) sufficiently dispersed in a foamed ethylene-propylene-diene terpolymer (EPDM) onto a 10 mm dia.-core metal 7*b*. The elastic layer 7*a* of the transfer roller 7 showed a hardness of 35 degrees as measured by JIS K-6301 and a volume resistivity of $10^6$ ohm.cm. The transfer from the intermediate transfer member 5 to a transfer-receiving material 6 was performed by applying a voltage to the transfer roller 7 to provide a transfer current of 15 μA.

The heat-fixing device H was a hot roller-type fixing device having no oil applicator system. The upper roller and lower roller are both surfaced with a fluorine-containing resin and have a diameter of 60 mm. The fixing temperature was 150° C. and the nip width was set to 7 mm.

Under the above-set conditions, each of the above-prepared Developers (A)–(I) was evaluated by a single-color mode continuous printing test (i.e., by a toner consumption promotion mode without pose of the developing device) while replenishing the corresponding black toner as required at a print-out speed of 8 A-4 size sheets/min. in an environment of normal temperature/normal humidity (N.T./N.H.= 25° C./60%RH) or high temperature/high humidity (H.T./H.H.=30° C./80%RH), whereby the printed-out image quality was evaluated.

Each developer was also evaluated with respect to matching with the image forming apparatus used.

Residual toner recovered by cleaning was conveyed to and re-used in the developing device by means of a re-use mechanism.

Further, a fixing test was performed by removing the fixing apparatus by attaching an external drive mechanism so as to rotate the fixing roller at a speed of 15 mm/sc and attaching a temperature controller so as to adjust the fixing roller temperature within a range of 100–230° C.

The fixing test was performed after the upper roller (heating roller) reaching a prescribed temperature and retaining the temperature for further 10 minutes to confirm that the lower roller (pressure roller) had been sufficiently heated to a constant temperature.

The results of the above-described evaluation are shown in Tables 4 and 5.

TABLE 4

| Ex. or Comp. Ex. | Developer | Fixability | Anti-offset | Fixable temp. range $T_{Fix.\,min}$ | $T_{Fix.\,max}$ | 25° C./60% RH I.D. | Fog | 30° C./80% RH I.D. | Fog |
|---|---|---|---|---|---|---|---|---|---|
| Ex. 7 | (A) | A | A | 120 | 210 | A | A | A | A |
| Ex. 8 | (B) | A | A | 130 | 210 | A | B | A | A |

TABLE 4-continued

| Ex. or Comp. Ex. | Developer | Fixability | Anti-offset | Fixable temp. range $T_{Fix.min}$ | Fixable temp. range $T_{Fix.max}$ | 25° C./60% RH I.D. | 25° C./60% RH Fog | 30° C./80% RH I.D. | 30° C./80% RH Fog |
|---|---|---|---|---|---|---|---|---|---|
| Ex. 9 | (C) | A | C | 130 | 190 | A | B | A | B |
| Ex.10 | (D) | B | C | 130 | 190 | A | B | B | B |
| Ex.11 | (E) | B | C | 140 | 180 | A | B | C | B |
| Ex.12 | (F) | C | A | 150 | 220 | A | B | B | B |
| Comp. | | | | | | | | | |
| Ex. 4 | (G) | D | D | 170 | 190 | B | D | D | D |
| Ex. 5 | (H) | D | C | 180 | 200 | B | D | D | D |
| Ex. 6 | (I) | D | D | 160 | 180 | B | D | C | D |

TABLE 5

| | Matching with image forming apparatus: Photosensitive drum | Intermediate transfer member | Fixing device |
|---|---|---|---|
| Ex. 7 | A | A | A |
| Ex. 8 | A | A | A |
| Ex. 9 | B | A | B |
| Ex. 10 | B | A | B |
| Ex. 11 | B | A | C |
| Ex. 12 | A | B | B |
| Comp. Ex. 4 | D | D | C |
| Comp. Ex. 5 | D | D | C |
| Comp. Ex. 6 | C | D | D |

Explanation of evaluation items shown in the above Tables will be supplemented hereinbelow.

Print-Out Image Evaluation

<1> I.D. (Image Density)

Evaluated based on a relative image density after printing out on a prescribed number of ordinary copying paper (75 g/m$^2$) by a Macbeth reflective densitometer relative to a print-out image of a white ground portion having an original density of 0.00 according to the following standard:

A: Very good (≧1.40)
B: Good (≧1.35 and <1.40)
C: Fair (≧1.00 and <1.35)
D: Poor (<1.00)

<2> Fog

Image fog was evaluated based on a fog density (%) based on a difference in whiteness (reflectance) between a white ground portion of a printed-out image and transfer paper per se before printing based on values measured by using a reflective densitometer ("REFLECTOMETER" available from Tokyo Denshoku K.K.)

A: Very good (<1.5%)
B: Good (≧1.5% and <2.5%)
C: Fair (≧2.5% and <4.0%)
D: Poor (≧4%) <3> Fixability A fixed toner image was rubbed with a soft tissue paper (lens-cleaning paper) under a load of 50 g/cm$^2$ to measure a decrease (%) in image density for evaluation of the fixability.

A: Very good (<5%)
B: Good (≧5% and <10%)
C: Fair (≧10% and <20%)
D: Poor (≧20%)

<4> Anti-Offset Characteristic

A sample image having an image areal percentage of ca. 5% was continually printed, and the degree of soiling on a print-out sheet was evaluated after printing on 3000 sheets.

A: Very good (Not observable)
B: Good (Substantially not observable)
C: Fair
D: Poor <5> $T_{Fix.min}$. (Lowest Fixable Temperature)

Fixed images were each rubbed for 10 reciprocations with a lens-cleaning member ("Dusper" (trade name), mfd. by OZU Paper, Co., Ltd.) under a load of 50 g/cm$^2$, and a lowest one of the fixing temperatures giving a lowering in image density due to the rubbing of at most 20% was taken as the lowest fixable temperature ($T_{Fix.min}$).

<6> $T_{Fix.max}$ (Anti-High-Temperature offset Temperature)

The occurrence of high-temperature offset was evaluated by the observation with respect to fixed images at various fixing temperatures, and a highest fixing temperature free from high-temperature offset was taken as an anti-high-temperature offset temperature ($T_{Fix.max}$)

Evaluation of Matching with the Image Forming Apparatus

<1> Matching with a Developing Sleeve

After the print-out test, the state of occurrence of residual toner sticking onto the developing sleeve surface and the influence thereof on the printed-out images were evaluated with eyes.

A: Very good (not observed)
B: Good (almost not observed)
C: Fair (sticking observed but little influence on the images)
D: Poor (much sticking and resulted in image irregularity)

<2> Matching with a Photosensitive Drum

After the print-out test, the damages on the photosensitive drum surface, the state of occurrence of residual toner sticking onto the drum surface and the influences thereof on the printed-out images were evaluated with eyes.

A: Very good (not observed)
B: Good (slight damage observed but no influence on the images)
C: Fair (sticking and damage observed but little influence on the images)
D: Poor (much sticking and resulted in vertical streak image defects)

<3> Matching with an Intermediate Transfer Member

After the print-out test, the state of damages and residual toner sticking on the surface of the intermediate transfer member, and the influence thereof on the printed-out images, were evaluated with eyes.

A: Very good (not observed)

B: Good (surface residual toner observed but no influence on the images)

C: Fair (sticking and damage observed but little influence on the images)

D: Poor (much sticking and resulted in image irregularity)

<4> Matching with a Fixing Device

After the print-out test, the state of damage and residual toner sticking on the fixing film, and the influence thereof on the printed-out images, were evaluated with eyes.

A: Very good (not observed)

B: Good (slight sticking observed but no influence on the images)

C: Fair (sticking and damage observed but little influence on the images)

D: Poor (much sticking and resulted in image defects)

EXAMPLE 13 AND COMPARATIVE EXAMPLE 7

The developing device of the image forming apparatus shown in FIG. 3 and used in Example 19, etc. was replaced by one illustrated in FIG. 5, and each of Toner (A) and Comparative Toner(G) was subjected to an image forming test according to an intermittent mode wherein a pause of 10 sec. was inserted between successive image formation cycles so as to promote the deterioration of the toner due to a preliminary operation accompanying re-start-up of the developing device, while setting the peripheral moving speed of the toner carrying member to 3.0 times that of the electrostatic image-bearing member and successively replenishing the toner as required. The evaluation was performed similarly as in Example 7, etc.

The toner-carrying member used had a surface roughness Ra of 1.5, the toner regulating blade was one obtained applying a urethane rubber sheet onto a phosphor bronze base sheet and further coating it with nylon to provide an abutting surface. The fixing device H was replaced by one illustrated in FIGS. 6 and 7 including a heating member for heating the toner image via a heat-resistant film. The heating member 31 was set to have a surface temperature of 130° C. as measured by a temperature-detecting element 31*d*, and the heating member 31 was abutted against the sponge pressure roller 33 at a total pressure of 8 kg so as to provide a nip of 6 mm between the sponge pressure roller 33 and the fixing film 32. The fixing film 32 comprised a 60 $\mu$m-thick heat-resistant polyimide film coated with a low-resistivity release layer comprising polytetrafluoroethylene (of high molecular weight-type) with an electroconductive substance therein on its surface contacting a transfer paper.

The results of evajuation are shown in Table 6.

EXAMPLE 14 AND COMPARATIVE EXAMPLE 8

Figure 8:
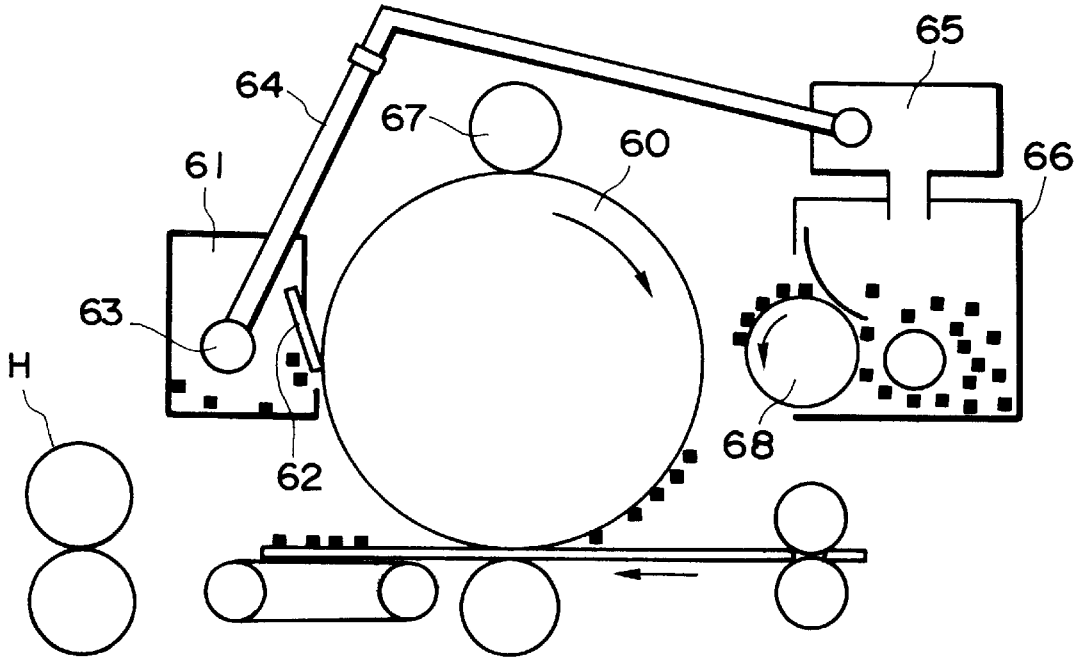
FIG. 8 is a schematic illustration of an image forming apparatus wherein a non-transferred portion of the toner is re-used.

A commercially available laser beam printer ("LBP-EX", available from Canon K.K.) was used for testing after being remodeled by attaching a re-use mechanism. More specifically, the printer was provided with a system as shown in FIG. 8, wherein a residual (non-transferred) toner on a photosensitive drum 60 was scraped off by an elastic blade 62 abutted to the photosensitive drum of a cleaner 61 and fed to an inside of the cleaner 61, and was further recycled to a developing apparatus 66 via a cleaner screw 63, a supplying pipe 64 equipped with a conveying screw and a hopper 65, for reuse of the recycled toner. For image formation, the photosensitive drum 60 was primarily charged by a primary charger roller 67 comprising a rubber roller containing electroconductive carbon dispersed therein, coated with nylon resin and having a diameter of 12 mm abutted against the photosensitive drum 60 at a pressure of 50 g/cm. The photosensitive drum 60 was further subjected to laser beam exposure at 600 dpi to form an electrostatic image with a dark-part potential $V_D$=−700 volts and a light-part potential $V_L$=−200 volts. The electrostatic image was developed with a toner carried on a toner-carrying in the form of a developing sleeve 68 coated with a carbon black-dispersed resin layer and having a surface roughness Ra=1.1. The developing sleeve 68 was equipped with a urethane rubber blade as a toner regulating member and rotated at a peripheral speed which was 1.1 times that of the photosensitive drum 60. The sleeve 68 was spaced from the photosensitive drum 60 at a gap of 270 $\mu$m, across which an AC-superposed DC voltage was applied as a developing bias voltage. The hot fixing apparatus H was operated at a set temperature of 150° C.

Under the above-set conditions, each of Toners (A) and (G) was subjected to an image forming test, while replenishing the toner as required according to an intermittent mode wherein a pause of 10 sec was inserted between successive image formation cycles so as to promote the deterioration of the toner due to a preliminary operation accompanying re-start-up of the developing device, at a print-out speed of 12 A4-size sheets/min in environments of normal temperature/normal humidity (25° C./60% RH) and high temperature/high-humidity 30° C./80% RH). Each toner was evaluated with respect to similar items as the preceding Examples and the results of evaluation are summarized in Table 7.

TABLE 6

| | Print-out image evaluation and matching with apparatus | | | | | | | | |
|---|---|---|---|---|---|---|---|---|---|
| | | | | Print-out image | | | | Matching with | |
| | | Fixa- | Anti- | 25° C./60% RH | | 30° C./80% RH | | | Transfer |
| | Toner | bility | offset | I.D. | Fog | I.D. | Fog | Sleeve | member |
| Ex. 13 | (A) | A | A | A | A | A | A | A | A |
| Comp. Ex. 7 | (G) | C | C | C | C | D | D | C | D |

TABLE 7

Print-out image evaluation and matching with apparatus

| | | | | Print-out image | | | | Matching with | |
|---|---|---|---|---|---|---|---|---|---|
| | | Fixa- | Anti- | 25° C./60% RH | | 30° C./80% RH | | | Fixing |
| | Toner | bility | offset | I.D. | Fog | I.D. | Fog | Sleeve | device |
| Ex. 14 | (A) | A | A | A | A | A | A | A | A |
| Comp. Ex. 8 | (G) | D | C | D | C | D | D | D | D |

EXAMPLE 15

Toner (A) was subjected to a print-out test similarly as in Example 14 except that the toner re-use mechanism as shown in FIG. 8 was removed, the print-out speed was changed to 16 A4-size sheets/min and the print-out test was performed in a continuous mode (i.e., a toner consumption promotion mode without pause of the developing device) while replenishing the toner as required.

Toner (A) was evaluated with respect to the same items of the printed-out images and also with respect to matching with the image forming apparatus, similarly as in Example 14, whereby Toner (A) exhibited good performances with respect to all the items evaluated.

EXAMPLE 16

Yellow toner particles, magenta toner particles and cyan toner particles were prepared in the same manner as in Example 3 except for replacing the carbon black with 6 wt. parts each of a yellow colorant (C.I. Pigment Yellow 13), a magenta colorant (C.I. Pigment Red 57:1) and a cyan colorant (C.I. Pigment Blue 15:3), respectively.

The physical properties and characteristic values of the respective color toner particles are shown in Tables 8–10.

Similarly as in Example 1, the color toner particles were formulated into Yellow toner, Magenta toner and Cyan toner, respectively, and Yellow developer, Magenta developer and Cyan developer. These developers were incorporated in the developing units 4-1, 4-2 and 4-3, respectively, of the image forming apparatus shown in FIG. 3 and subjected to a full-color image forming test together with Black Developer (A) contained in the developing units 4-4, similarly as in Example 1. As a result, even according to the oilless fixing mode, clear full-color images could be obtained without any offset and exhibited sufficient color mixability.

TABLE 8

Composition of binder resins

| | Contents of Components A, B & C | | | | | Molecular weight distribution of THF-soluble content | | |
|---|---|---|---|---|---|---|---|---|
| Toner particles | A (wt. %) | B (wt. %) | C (wt. %) | B + C (wt. %) | Mp ($\times 10^4$) | Components of $\leqq 5 \times 10^4$ (%) | Components of $5 \times 10^4$–$10^6$ (%) | Components of $\geqq 10^6$ (%) |
| Yellow | 91 | 4 | 5 | 9 | 1.7 | 76 | 20 | 4.2 |
| Magenta | 91 | 4 | 5 | 9 | 1.8 | 75 | 21 | 4.2 |
| Cyan | 91 | 4 | 5 | 9 | 1.7 | 76 | 20 | 4.2 |

TABLE 9

Characterization of Components A, B and C in the binder resin

| | Component B | | Component C | | Component A | | |
|---|---|---|---|---|---|---|---|
| Toner particles | Polyester in B (wt. %) | Polyester based on binder (wt. %) | Polyester in C (wt. %) | Polyester based on binder (wt. %) | Polyester in A (wt. %) | Polyester based on binder (wt. %) | Vinyl polymer in A (wt. %) |
| Yellow | 33 | 1.3 | 14 | 0.7 | 0 | 0 | 100 |
| Magenta | 35 | 1.4 | 12 | 0.6 | 0 | 0 | 100 |
| Cyan | 33 | 1.3 | 14 | 0.7 | 0 | 0 | 100 |

TABLE 10

| Toner particles | Shape factors SF-1 | SF-2 | SF-2/SF-1 | Particle size distribution* $D_4$ (μm) | $A_{NV}$ (%) | Wax dispersion state (TEM) |
|---|---|---|---|---|---|---|
| Yellow | 122 | 111 | 0.91 | 6.8 | 28 | spherical |
| Magenta | 128 | 107 | 0.84 | 6.7 | 26 | spherical |
| Cyan | 121 | 113 | 0.84 | 6.6 | 29 | spherical |

*: D4: weight-average particle size
$A_{NV}$: number-basis particle size variation coefficient (= S/D1 × 100, s: standard deviation, D1 = number-average particle size.

What is claimed is:

1. A toner for developing electrostatic images, comprising: toner particles containing at least a binder resin, a colorant, and a wax, wherein (I) the binder resin comprises a hybrid component comprising a unit of vinyl polymer component and a unit of polyester component bonded to each other, and the vinyl polymer component has been crosslinked with a crosslinkinq agent;

(II) the binder resin contains 40–99 wt. % of a component A, 0–20 wt. % of a component B, and 0–60 wt. % of a component C, the components B and C providing totally 1–60 wt. % of the binder resin; wherein the component A comprises low- and medium-molecular weight components having molecular weights of below $10^6$ and the component B comprises high-molecular weight components having molecular weights of at least $10^6$, respectively, based on a chromatogram obtained by gel permeation chromatography of a tetrahydrofuran (THF)-soluble component of the binder resin, and the component C is a THF-insoluble component of the binder resin;

(III) the chromatogram obtained by GPC of the THF-soluble component of the binder resin exhibits a main peak in a molecular weight region of $3\times10^3$–$5\times10^4$; and (IV) the toner particles have a shape factor SF-1 of 100–160 and a shape factor SF-2 of 100–140.

2. The toner according to claim 1, wherein the polyester component occupies 0–90 wt. % of the component B, 0–90 wt. % of the component C, and 0.02–90 wt. % of the total of the components B and C.

3. The toner according to claim 1, wherein the polyester component occupies 0.1–20 wt. % of the binder resin.

4. The toner according to claim 1, wherein the polyester component occupies 0.1–10 wt. % of the binder resin.

5. The toner according to claim 1, wherein the polyester component occupies 0.1–5 wt. % of the binder resin.

6. The toner according to claim 1, wherein the polyester component occupies 0.1–20 wt. % of the binder resin, 0–90 wt. % of the component B, 0–90 wt. % of the component C, and 0.02–90 wt. % of the total of the components B and C.

7. The toner according to claim 6, wherein the polyester component occupies 0.1–10 wt. % of the binder resin.

8. The toner according to claim 6, wherein the polyester component occupies 0.1–5 wt. % of the binder resin.

9. The toner according to claim 1, wherein the THF-soluble content of the binder resin provides a GPC chromatogram exhibiting a main peak in a molecular weight region of $3\times10^3$–$4\times10^4$.

10. The toner according to claim 1, wherein the THF-soluble content of the binder resin provides a GPC chromatogram exhibiting a main peak in a molecular weight region of $1\times10^4$–$3\times10^4$.

11. The toner according to claim 1, wherein the THF-soluble content of the binder resin exhibits a weight-average molecular weight of at least $10^5$.

12. The toner according to claim 1, wherein the vinyl polymer occupies at least 70 wt. % of the component A.

13. The toner according to claim 1, wherein the vinyl polymer occupies at least 75 wt. % of the component A.

14. The toner according to claim 1, wherein the vinyl polymer occupies at least 85 wt. % of the component A.

15. The toner according to claim 1, wherein the components B and C totally occupy 5–58 wt. % of the binder resin.

16. The toner according to claim 15, wherein the component B occupies 2–15 wt. % and the component C occupies 3–55 wt. %, respectively, of the binder resin.

17. The toner according to claim 1, wherein the binder resin contains 2–10 wt. % of the component B, 5–45 wt. % of the component C, and 7–49 wt. % of the total of the components B and C, respectively based on the binder resin.

18. The toner according to claim 1, wherein the toner particles have a weight-average particle size of 4–9 μm and a number-basis particle size variation coefficient of at most 35%.

19. The toner according to claim 1, wherein the toner particles have a number-basis particle size variation coefficient of 20–30%.

20. The toner according to claim 1, wherein the toner particles have a shape factor SF-1 of 100–140 and a shape factor SF-2 of 100–120.

21. The toner according to claim 1, wherein the wax provides a DSC heat-absorption curve exhibiting a heat-absorption main peak in a temperature region of 40–150° C.

22. The toner according to claim 1, wherein the wax provides a DSC heat-absorption curve exhibiting a heat-absorption main peak in a temperature region of 45–145° C.

23. The toner according to claim 1, wherein the wax provides a DSC heat-absorption curve exhibiting a heat-absorption main peak in a temperature region of 50–100° C.

24. The toner according to claim 1, wherein the vinyl polymer component comprises a styrene-acrylate copolymer or a styrene-methacrylate copolymer.

25. The toner according to claim 1, wherein the polyester component has a bisphenol A derivative unit represented by the following formula:

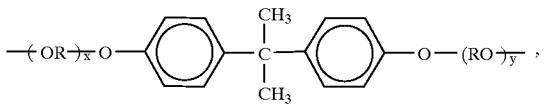

wherein R denotes an ethylene or propylene group, and x and y are respectively an integer of at least 1 providing an average of x+y in a range of 2–10.

26. The toner according to claim 1, wherein the polyester component comprises an unsaturated polyester having a vinyl unit.

27. The toner according to claim 1, wherein the toner particles comprises resin particles comprising a vinyl polymer component, a polyester component, a colorant and a wax formed by dispersing a polymerizable monomer composition comprising at least a vinyl monomer, an unsaturated polyester, the colorant and the wax in an aqueous medium to form particles of the polymerizable monomer composition, and polymerizing the vinyl monomer in the particles of the polymerizable monomer composition.

28. The toner according to claim 27, wherein the polymerizable monomer composition comprises at least styrene monomer, an acrylate monomer, divinylbenzene, an unsaturated polyester, a colorant, a wax and a polymerization initiator, and the resultant resin particles comprise a vinyl polymer, and a hybrid component comprising a vinyl polymer unit and an unsaturated polyester unit bonded to each other.

29. The toner according to claim 28, wherein the unsaturated polyester has a weight-average molecular weight of $3\times10^3$–$10^5$.

30. The toner according to claim 29, wherein the unsaturated polyester has an acid value of 2–20 mgKOH/g.

31. The toner according to claim 28, wherein the unsaturated polyester comprises a polycondensate between a dihydric alcohol and a dicarboxylic acid having a vinyl group.

32. The toner according to claim 31, wherein the unsaturated polyester comprises a polycondensate between a bisphenol A derivative of the following formula (A) and a dicarboxylic acid having a vinyl group:

(A)

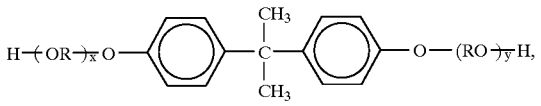

wherein R denotes an ethylene or propylene group, and x and y are respectively an integer of at least 1 providing an average of x+y in a range of 2–10.

33. The toner according to claim 32, wherein the dicarboxylic acid having a vinyl group is fumaric acid, maleic acid or maleic anhydride, and the unsaturated polyester is a linear polyester.

34. The toner according to claim 27, wherein the polymerizable monomer composition comprises at least styrene monomer, a methacrylate monomer, divinylbenzene, an unsaturated polyester, a colorant, a wax and a polymerization initiator, and the resultant resin particles comprise a vinyl polymer, and a hybrid component comprising a vinyl polymer unit and an unsaturated polyester unit bonded to each other.

35. The toner according to claim 34, wherein the unsaturated polyester has a weight-average molecular weight of $3\times10^3$–$10^5$.

36. The toner according to claim 35, wherein the unsaturated polyester has an acid value of 2–20 mgKOH/g.

37. The toner according to claim 34, wherein the unsaturated polyester comprises a polycondensate between a dihydric alcohol and a dicarboxylic acid having a vinyl group.

38. The toner according to claim 37, wherein the unsaturated polyester comprises a polycondensate between a bisphenol A derivative of the following formula (A) and a dicarboxylic acid having a vinyl group:

(A)

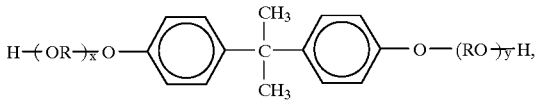

wherein R denotes an ethylene or propylene group, and x and y are respectively an integer of at least 1 providing an average of x+y in a range of 2–10.

39. The toner according to claim 38, wherein the dicarboxylic acid having a vinyl group is fumaric acid, maleic acid or maleic anhydride, and the unsaturated polyester is a linear polyester.

40. The toner according to claim 27, wherein the polymerizable monomer composition further contains a saturated polyester.

41. The toner according to claim 1, wherein the component B contains a hybrid component comprising a vinyl polymer unit and an unsaturated polyester unit bonded to each other.

42. The toner according to claim 1, wherein the component C contains a hybrid component comprising a vinyl polymer unit and an unsaturated polyester unit bonded to each other.

43. The toner according to claim 1, wherein the toner particles contain a wax enclosed therein and are surfaced with a hybrid component comprising a vinyl polymer unit and an unsaturated polyester unit bonded to each other.

44. The toner according to claim 1, wherein the wax is contained in a proportion of 2–30 wt. % of the toner particles.

45. The toner according to claim 1, wherein the wax is contained in a proportion of 3–25 wt. % of the toner particles.

46. An image forming method, comprising:

a charging step for applying a voltage to a charging member from an external source, thereby charging an electrostatic image-bearing member, a latent image forming step for forming an electrostatic image on the charged electrostatic image-bearing member;

a developing step for developing the electrostatic image with a toner supplied from a toner-carrying member to form a toner image on the electrostatic image-bearing member, a transfer step for transferring the toner image on the electrostatic image-bearing member onto a transfer material, and a fixing step for fixing the toner image on the transfer material under application of heat and pressure;

wherein the toner comprises toner particles containing at least a binder resin, a colorant, and a wax, wherein (I) the binder resin comprises a hybrid component comprising a unit of vinyl polymer component and a unit of polyester component bonded to each other, and the vinyl polymer component has been crosslinked with a crosslinking agent;

(II) the binder resin contains 40–99 wt. % of a component A, 0–20 wt. % of a component B, and 0–60 wt. % of a component C, the components B and C providing totally 1–60 wt. % of the binder resin; wherein the component A comprises low- and medium-molecular weight components having molecular weights of below $10^6$ and the component B comprises high-molecular weight components having molecular weights of at least $10^6$, respectively, based on a chromatogram obtained by gel permeation chromatography of a tetrahydrofuran (THF)-soluble component of the binder resin, and the component C is a THF-insoluble component of the binder, resin;

(III) the chromatogram obtained by GPC of the THF-soluble component of the binder resin exhibits a main peak in a molecular weight region of $3\times10^3$–$5\times10^4$; and (IV) the toner particles have a shape factor SF-1 of 100–160 and a shape factor SF-2 of 100–140.

47. The method according to claim 46, wherein in the developing step, the toner-carrying member is moved at a surface-moving velocity which is 1.05–3.0 times that of the electrostatic image-bearing member, and the toner-carrying member has a surface roughness (Ra) of at most 1.5 μm.

48. The method according to claim 46, wherein the toner-carrying member is equipped with a toner layer-regulating blade disposed with a gap from the toner-carrying member.

49. The method according to claim 46, wherein the toner-carrying member is equipped with an elastic blade abutted against the toner-carrying member.

50. The method according to claim 46, wherein the toner-carrying member is disposed with a prescribed gap from the electrostatic image-bearing member, and the electrostatic image is developed with the toner under application of an alternating electric field across the gap.

51. The method according to claim 46, wherein the electrostatic image on the electrostatic image-bearing member is developed with a layer of the toner carried on the toner-carrying member and contacting the electrostatic image-bearing member.

52. The method according to claim 46, wherein in the charging step, the electrostatic image-bearing member is charged by the charging member which contacts the electrostatic image-bearing member and is supplied with a voltage from the external source.

53. The method according to claim 46, wherein in the transfer step, the toner image on the electrostatic image-bearing member is electrostatically transferred onto the transfer material under the operation of a transfer member abutted to the electrostatic image-bearing member via the transfer material.

54. The method according to claim 46, wherein in the fixing step, the toner image on the transfer material is fixed onto the transfer material by a heat and pressure fixing device which is not equipped with an offset prevention liquid-supply mechanism or a cleaner therefor.

55. The method according to claim 46, wherein in the fixing step, the toner image is fixed onto the transfer material under application of heat and pressure from a fixing device comprising a fixedly supported heating member and a pressing member pressed against the heating member via a film.

56. The method according to claim 46, further including steps for cleaning and recovering a non-transferred residual toner on the electrostatic image-bearing member after the transfer step and recycling the recovered toner to a developing apparatus including the toner-carrying member, so as to re-use the toner for developing an electrostatic image on the electrostatic image-bearing member.

57. An image forming method, comprising:

a charging step for applying a voltage to a charging member from an external source, thereby charging an electrostatic image-bearing member, a latent image forming step for forming a first electrostatic image on the charged electrostatic image- bearing member, a developing step for developing the first electrostatic image with a first toner supplied from a first toner-carrying member to form a first toner image on the electrostatic image-bearing member, a first type of transfer step for transferring the first toner image on the electrostatic image-bearing member onto an intermediate transfer member, a charging step for applying a voltage to the charging member from the external source, thereby charging the electrostatic image-bearing member, a latent image forming step for forming a second electrostatic image on the charged electrostatic image-bearing member, a developing step for developing the second electrostatic image with a second toner supplied from a second toner-carrying member to form a second toner image on the electrostatic image-bearing member, a first type of transfer step for transferring the second toner image on the electrostatic image-bearing member onto the intermediate transfer member, a second type of transfer step for transferring the first toner image and the second toner image on the intermediate transfer member onto a transfer material, and a fixing step for fixing the first and second toner images on the transfer material under application of heat and pressure;

wherein the first or second toner comprises toner particles containing at least a binder resin, a colorant, and a wax, wherein (I) the binder resin comprises a hybrid component comprising a unit of vinyl polymer component and a unit of polyester component bonded to each other, and the vinyl polymer component has been crosslinked with a crosslinking agent;

(II) the binder resin contains 40–99 wt. % of a component A, 0–20 wt. % of a component B, and 0–60 wt. % of a component C, the components B and C providing totally 1–60 wt. % of the binder resin; wherein the component A comprises low- and medium-molecular weight components having molecular weights of below $10^6$ and the component B comprises high-molecular weight components having molecular weights of at least $10^6$, respectively, based on a chromatogram obtained by gel permeation chromatography of a tetrahydrofuran (THF)-soluble component of the binder resin, and the component C is a THF-insoluble component of the binder resin;

(III) the chromatogram obtained by GPC of the THF-soluble component of the binder resin exhibits a main peak in a molecular weight region of $3\times10^3$–$5\times10^4$; and (IV) the toner particles have a shape factor SF-1 of 100–160 and a shape factor SF-2 of 100–140.

58. The method according to claim 57, wherein in the developing step, each of the first and second toner-carrying members is moved at a surface-moving velocity which is 1.05–3.0 times that of the electrostatic image-bearing member, and the toner-carrying member has a surface roughness (Ra) of at most 1.5 μm.

59. The method according to claim 57, wherein each of the first and second toner-carrying members is equipped with a toner layer-regulating blade disposed with a gap from the toner-carrying member.

60. The method according to claim 57, wherein each of the first and second toner-carrying members is equipped with an elastic blade abutted against the toner-carrying member.

61. The method according to claim 57, wherein each of the first and second toner-carrying members is disposed with a prescribed gap from the electrostatic image-bearing member, and the electrostatic image is developed with the toner under application of an alternating electric field across the gap.

62. The method according to claim 57, wherein the electrostatic image on the electrostatic image-bearing member is developed with a layer of the toner carried on each of the first and second toner-carrying members and contacting the electrostatic image-bearing member.

63. The method according to claim 57, wherein in the charging step, the electrostatic image-bearing member is charged by the charging member which contacts the electrostatic image-bearing member and is supplied with a voltage from the external source.

64. The method according to claim 57, wherein in the transfer step, the toner image on the electrostatic image-bearing member is electrostatically transferred onto the transfer material under the operation of a transfer member abutted to the electrostatic image-bearing member via the transfer material.

65. The method according to claim 57, wherein in the fixing step, the toner image on the transfer material is fixed onto the transfer material by a heat and pressure fixing device which is not equipped with an offset prevention liquid-supply mechanism or a cleaner therefor.

66. The method according to claim 57, wherein in the fixing step, the toner image is fixed onto the transfer material under application of heat and pressure from a fixing device comprising a fixedly supported heating member and a pressing member pressed against the heating member via a film.

67. The method according to claim 57, further including steps for cleaning and recovering a non-transferred residual toner on the electrostatic image-bearing member after the transfer step and recycling the recovered toner to a developing apparatus including the toner-carrying member, so as to re-use the toner for developing an electrostatic image on the electrostatic image-bearing member.

* * * * *

UNITED STATES PATENT AND TRADEMARK OFFICE

CERTIFICATE OF CORRECTION

PATENT NO. : 5,948,584

DATED : September 7, 1999

INVENTOR(S) : AKIRA HASHIMOTO ET AL.

It is certified that error appears in the above-identified patent and that said Letters Patent is hereby corrected as shown below:

Title page,
AT [57] ABSTRACT

Line 12, "106," should read --$10^6$,--.

COLUMN 4

Line 28, "reliability" should read --reliable--.

COLUMN 8

Line 27, "wet." should read --wt.--.

COLUMN 15

Line 5, "earl" should read --(each--.

COLUMN 17

Line 24, "to" should read --to bring about--.

COLUMN 18

Line 54, "and odor" should read --an odor--.

COLUMN 21

Line 43, "lien" should read --line--.

UNITED STATES PATENT AND TRADEMARK OFFICE

CERTIFICATE OF CORRECTION

PATENT NO. : 5,948,584

DATED : September 7, 1999

INVENTOR(S) : AKIRA HASHIMOTO ET AL.

It is certified that error appears in the above-identified patent and that said Letters Patent is hereby corrected as shown below:

COLUMN 22

Line 22, "so that" should be deleted; and
Line 28, "forth" should be deleted.

COLUMN 24

Line 37, "omitting" should read --eliminating--; and
Line 47, "members" should read --member--.

COLUMN 30

Table 1, "63 --65
43" should read 43--.

COLUMN 31

Line 47, "images" should read --image--.

COLUMN 32

Line 31, "pose" should read --pause--.

COLUMN 36

Line 27, "toner-carrying" should read --toner-carrying member--.

UNITED STATES PATENT AND TRADEMARK OFFICE

CERTIFICATE OF CORRECTION

PATENT NO. : 5,948,584

DATED : September 7, 1999

INVENTOR(S) : AKIRA HASHIMOTO ET AL.

It is certified that error appears in the above-identified patent and that said Letters Patent is hereby corrected as shown below:

COLUMN 40

Line 57, "comprises" should read --comprise--.

COLUMN 43

Line 52, "image- bearing" should read --image-bearing--.

Signed and Sealed this

Twenty-second Day of August, 2000

*Attest:*

*Attesting Officer*

Q. TODD DICKINSON

*Director of Patents and Trademarks*